US005766814A

United States Patent [19]

Baba et al.

[11] Patent Number: 5,766,814

[45] Date of Patent: Jun. 16, 1998

[54] MAGNETIC COATED CARRIER, TWO-COMPONENT TYPE DEVELOPER AND DEVELOPING METHOD

[75] Inventors: Yoshinobu Baba, Yokohama; Takeshi Ikeda, Kawasaki; Yuko Sato, Numazu; Hitoshi Itabashi; Yuzo Tokunaga, both of Yokohama, all of Japan

[73] Assignee: Cannon Kabushiki Kaisha, Tokyo, Japan

[21] Appl. No.: 826,678

[22] Filed: Apr. 7, 1997

[30] Foreign Application Priority Data

Apr. 8, 1996 [JP] Japan ..... 8-085285

[51] Int. Cl.[6] ..... G03G 9/107

[52] U.S. Cl. ..... 430/106.6; 430/108; 430/111; 430/122

[58] Field of Search ..... 430/106.6, 108, 430/111, 122

[56] References Cited

U.S. PATENT DOCUMENTS

| | | | |
|---|---|---|---|
| 5,439,771 | 8/1995 | Baba et al. | 430/111 |
| 5,545,501 | 8/1996 | Tavernier et al. | 430/108 |
| 5,709,975 | 1/1998 | Yoerger et al. | 430/108 |

FOREIGN PATENT DOCUMENTS

| | | |
|---|---|---|
| 0351712 | 1/1990 | European Pat. Off. . |
| 0584555 | 3/1994 | European Pat. Off. . |
| 0650099 | 4/1995 | European Pat. Off. . |
| 0662643 | 7/1995 | European Pat. Off. . |
| 0693712 | 1/1996 | European Pat. Off. . |
| 0704767 | 4/1996 | European Pat. Off. . |
| 0708378 | 4/1996 | European Pat. Off. . |

*Primary Examiner*—Roland Martin
*Attorney, Agent, or Firm*—Fitzpatrick, Cella, Harper & Scinto

[57] ABSTRACT

A magnetic coated carrier suitable for constituting a two-component type developer for use in electrophotography is composed of magnetic coated carrier particles comprising magnetic carrier core particles and a resinous surface coated layer coating the magnetic carrier core particles. The carrier is suitably constituted so as to satisfy the condition of: (a) the magnetic carrier core particles has a resistivity of at least $1\times10^{10}$ ohm.cm, and the magnetic coated carrier has a resistivity of at least $1\times10^{12}$ ohm.cm, (b) the magnetic coated carrier has a number-average particle size of 1–100 μm and has such a particle size distribution that particles having particle sizes of at most a half of the number-average particle size occupy an accumulative percentage of at most 20% by number, (c) the magnetic coated carrier has a shape factor SF-1 of 100–130, (d) the magnetic coated carrier has a magnetization at 1 kilo-oersted of 40–250 emu/cm$^3$, and (e) the resinous surface coating layer comprises a coating resin composition which in turn comprises a straight silicone resin and a coupling agent. The straight silicone resin includes trifunctional silicon and difunctional silicon in an atomic ratio of 100:0–40:60.

72 Claims, 2 Drawing Sheets

MAGNETIC COATED CARRIER, TWO-COMPONENT TYPE DEVELOPER AND DEVELOPING METHOD

FIELD OF THE INVENTION AND RELATED ART

The present invention relates to a magnetic carrier for constituting a developer, a two-component type developer and a developing method for use in an image forming method, such as electrophotography and electrostatic recording.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner is attached onto the latent image to develop the latent image. Subsequently, the resultant toner image is transferred onto a transfer material such as paper, via or without via an intermediate transfer member, and then fixed e.g., by heating, pressing, or heating and pressing, or with solvent vapor, to obtain a copy or a print.

In recent years, along with development of computers and multi-media, there have been desired means for outputting further higher-definition full color images in wide fields from offices to home. Heavy users generally require high durability or continuous image forming performance fully from image quality deterioration even in a continuous copying or printing on a large number of sheets, and users in small offices or at home may require, in addition to high image quality, economization of space and energy which in turn requires apparatus size reduction, a system allowing re-utilization of toner or a waste toner-less (or cleaner-less) system, and a lower temperature fixation. Various studies have been made from various viewpoints for accomplishing these objects.

In the electrostatic (latent) image development step, charged toner particles are attached to an electrostatic (latent) image by utilizing electrostatic interaction with the electrostatic latent image, thereby forming a toner image. Among known developing methods using a toner for developing electrostatic images, the method using a two-component type developer comprising a mixture of a toner and a carrier has been suitably used in full-color copying machines and full-color printers requiring especially high image quality. In the transfer step, there has been preferably used an electrostatic transfer scheme of transferring charged toner particles constituting a toner image on an electrostatic image-bearing member onto a transfer(-receiving) material via or without via an intermediate transfer member. In the fixing step, there has been used a heating (and pressing) fixation scheme of passing a transfer material carrying a toner image between two rollers heated at around 200° C. or a pressure fixation scheme using rigid rollers in combination with a capsule toner Carrier particles in a two-component type developer are repetitively used for a long period in a cycle including steps of providing a sufficient charge to toner particles, allowing development of an electrostatic image with the toner in a developing region and recycling of the carrier particles per se into a developing device for re-mixing with a toner to provide a charge to the toner. Accordingly, the carrier particles are required of such performances as an ability of sufficiently charging a toner, non-attachment onto the electrostatic image-bearing member and non-deterioration in charge-imparting performance during repetitive use. Hitherto, as such a particulate carrier, there have been used an iron powder carrier, a ferrite carrier or a magnetic material-dispersed resin carrier comprising magnetic fine particles dispersed in a binder resin, particularly for constituting a two-component type developer for magnetic brush development scheme.

For complying with requirement for higher image quality, various developing methods have been studied. Among these, a method of applying an alternating electric field to a development region has been preferably used for high image quality. If an iron powder carrier is used in the system, an electric leakage is liable to occur because of low resistivity of the iron powder carrier, thus causing inferior development. Further, even if a ferrite carrier is used, it is difficult to obtain sufficiently good images at a resistivity level of $10^7$–$10^9$ ohm.cm of the ferrite carrier particles.

If ferrite carrier particles are coated with a resin, it becomes possible to obtain good images. However, if such a resin-coated carrier is repetitively used for a long period, the carrier can cause a lowering in charge-imparting performance due to soiling with a toner component or have a lower resistivity due to peeling of the coating resin, thus causing image quality deterioration in some cases.

In order to accomplish higher image quality through improvements in developers, it has been studied to reduce the particle size of the toner and carrier particles. In this case, as the carrier particle size is reduced, the carrier attachment is liable to occur. Japanese Laid-Open Patent Publication (JP-B) 5-8424 discloses a non-contact developing method using a carrier and a toner of smaller particle sizes under an oscillating electric field. The publication describes that the use of a carrier having an increased resistivity by resin coating is effective for improving the carrier attachment in a developing process under application of an oscillating electric field. However, even if a carrier is caused to have a higher resistivity for improving the carrier attachment, it can become insufficient to prevent the carrier attachment to realize a higher image quality in some cases such as a case where the carrier core has a low resistivity and is exposed to the surface even at a small proportion or peeling of the coating is caused during repetitive use.

If a magnetic material-dispersed resin carrier is used as a carrier, the carrier core is caused to have a higher resistivity than the iron powder carrier or the ferrite carrier. Japanese Laid-Open Patent Application (JP-A) 5-100494 discloses magnetic carrier particles comprising magnetic materials having different particle size ratios dispersed in a resin so as to increase the amount of the magnetic material in a resin; and the carrier can have an increased magnetic constraint force. However, in case where the magnetic material contains a species of magnetic material, such as magnetite, having a low resistivity and the carrier is used in a developing method using an alternating field, the carrier attachment can be caused due to frequent exposure of such low-resistivity magnetic particles. Further, during a long period of repetitive use, the magnetic fine particles can be liberated in some cases.

In order to alleviate the above-mentioned difficulties it has been studied to provide a carrier with an improved durability. In the case of a magnetic material-dispersed resin carrier, the coating with a low-surface energy resin has been proposed. For example, JP-B 62-61948 and JP-B 2-3181 have proposed silicone resin-coated carriers and JP-B 59-8827 has proposed a resin-modified silicone-coated carrier. JP-A 6-118725 describes magnetic material-dispersed resin carriers surface-coated with silicone resin containing an electroconductive substance and silicone resin containing a silane coupling agent. The JP-A publication describes that a magnetic material-dispersed resin carrier is coated with silicone resin containing an electroconductive substance so as to provide high-quality images in a continuous image formation. However, such a carrier can still cause a lowering in carrier resistivity leading to carrier attachment, particularly when used in a developing process using an alternating electric field. Further, also in the case of the resin carrier coated with silicone resin containing a silane coupling agent, the carrier attachment can still occur in case where the core contains a large amount of low-resistivity magnetic material as described above and the magnetic material particles are partially exposed in a substantial number of the surface of the carrier particles. Further, in a high humidity environment, fog can be caused due to a lowering in toner charge.

SUMMARY OF THE INVENTION

A generic object of the present invention is to provide a magnetic coated carrier, a two-component type developer and a developing method using such a two-component type developer, having solved the above-mentioned problems.

A more specific object of the present invention is to provide a magnetic coated carrier, a two-component type developer and a developing method using the two-component type developer capable of preventing carrier attachment and providing color toner images at a high image density and a high resolution.

Another object of the present invention is to provide a two-component type developer having a prolonged life and free from image deterioration even in image formation on a large number of sheets.

Another object of the present invention is to provide a two-component type developer using a magnetic material-dispersed resin carrier from which the liberation or isolation of the magnetic material is prevented, having a high durability and capable of providing high quality images.

Another object of the present invention is to provide a developer adapted to a low-temperature fixation process and a cleaner-less process, having an improved durability in repetitive use and free from filming on a photosensitive member.

Another object of the present invention is to provide a stable developing method adapted to a low-temperature fixation process and free from melt-sticking of the developer on a developer-carrying member for a long period.

According to the present invention, there is provided a magnetic coated carrier, comprising: magnetic coated carrier particles comprising magnetic carrier core particles and a resinous surface coating layer coating the magnetic carrier core particles, wherein (a) the magnetic carrier core particles has a resistivity of at least $1\times10^{10}$ ohm.cm, and the magnetic coated carrier has a resistivity of at least $1\times10^{12}$ ohm.cm, (b) the magnetic coated carrier has a number-average particle size of 1–100 μm and has such a particle size distribution that particles having particle sizes of at most a half of the number-average particle size occupy an accumulative percentage of at most 20% by number, (c) the magnetic coated carrier has a shape factor SF-1 of 100–130, (d) the magnetic coated carrier has a magnetization at 1 kilo-oersted of 40–250 emu/cm$^3$, and (e) the resinous surface coating layer comprises a coating resin composition which in turn comprises a straight silicone resin and a coupling agent, said straight silicone resin comprising trifunctional silicon and difunctional silicon in an atomic ratio of 100:0–40:60.

According to the present invention, there is also provided a two-component type developer for developing an electrostatic image, comprising: a toner and the above-mentioned magnetic coated carrier.

According to the present invention, there is further provided a developing method, comprising: carrying the above-mentioned two-component type developer on a developer-carrying member enclosing therein a magnetic field generating means, forming a magnetic brush of the two-component type developer on the developer-carrying member, causing the magnetic brush to contact an image-bearing member, and developing an electrostatic image on the image-bearing member while applying an alternating electric field to the developer-carrying member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
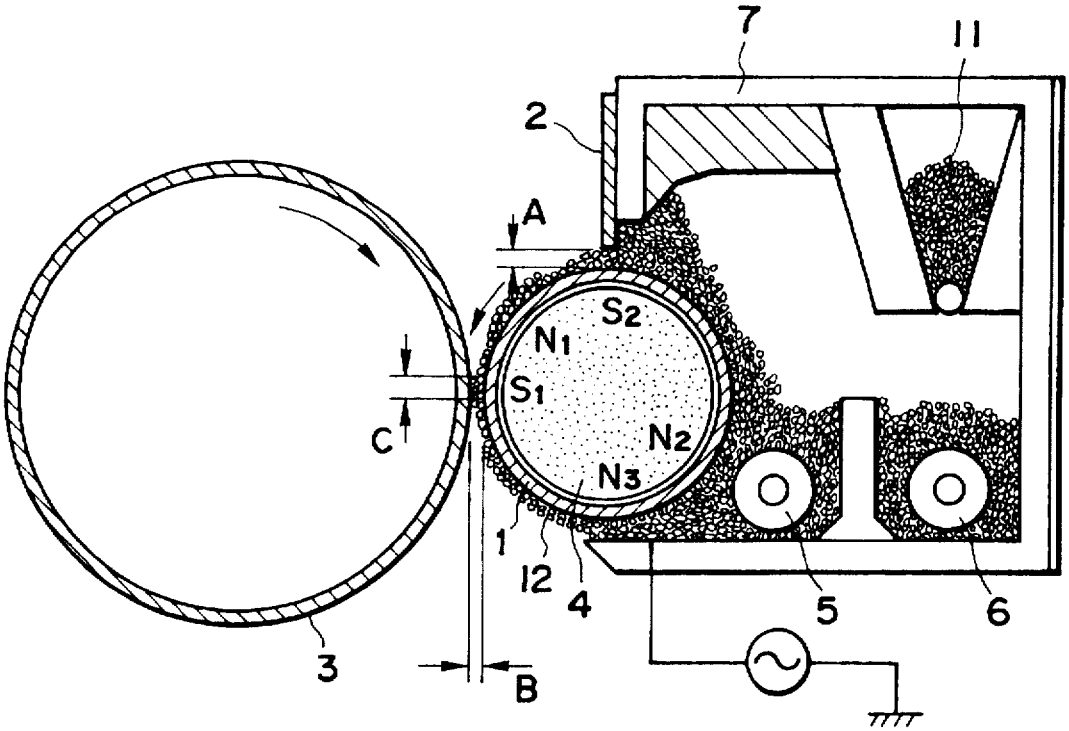
FIG. 1 is a schematic illustration of a developing section of an image forming apparatus suitable for practicing an embodiment of the developing method according to the invention.

As a result of our study, it has been found that the state of magnetic brush ear formation is related with the (strength of) magnetization of the magnetic carrier at a developing pole in a developing region (having a magnetic pole strength of ca. 1000 oersted) of a fixed magnetic enclosed within a developing sleeve (i.e., developer-carrying member). More specifically, it has been found possible to provide a dense magnetic brush at the developing pole and thus an image with good dot reproducibility by using a magnetic carrier having a magnetization in the range of 40–250 emu/cm$^3$ (at 1000 oersted) and a particle size in the range of 1–100 μm.

However, in contrast with an improved image quality, there has been observed an increased tendency of magnetic carrier attachment. For this reason, in the present invention, the magnetic carrier is so designed that (1) it has a number-average particle size of 1–100 μm and the particle size distribution is narrowed so as to contain at most 20% by number of particles thereof having sizes in the range of at most a half of the number-average particle size, and (2) the (electrical) resistivity thereof is increased so that it has a resistivity of at least $1\times10^{12}$ ohm.cm by using a core having an (electrical) resistivity of at least $1\times10^{10}$ ohm.cm and coating the core particles with a resin composition comprising a straight silicone resin and a coupling agent. As a result, the image quality is improved while avoiding the carrier attachment.

The effectiveness of the above-designed factors may be correlated with an assumption that the driving force of carrier attachment in a contact development process using a magnetic brush under application of an alternating electric field is controlled by charge injection from the developing sleeve to the magnetic carrier under application of the developing bias voltage.. Accordingly, the magnetic carrier core is required to have a resistivity sufficient to prevent the charge injection which has been found to be at least $1\times10^{10}$ ohm.cm It has been also found that in case of a magnetic material-dispersed resin carrier, if a magnetic material having a low resistivity of ca. $1\times10^{5}$ ohm.cm, such as magnetite, is contained in a high proportion of ca. 80 wt. % or more in the carrier core and the particles thereof are partially exposed to the surfaces of the carrier particles, charge-injection sites can be formed thereby to cause carrier attachment. Accordingly, even in the case of a magnetic material-dispersed resin carrier, it is necessary to take some measure for preventing the carrier attachment. The bulk resistivity of core can be increased if high-resistivity non-magnetic metal oxide particles are added as a carrier core component and the particle size thereof is made larger than that of magnetic fine particles having a generally low resistivity, thereby effectively preventing the charge injection.

As another factor, it has been found that the carrier attachment is also related with charging of the magnetic carrier during triboelectrification between the toner and the magnetic carrier. The charged magnetic carrier is little liable to be attached to the photosensitive member because of a magnetic force acting thereon and its weight if it has a large particle size, but a fine powder fraction of the magnetic carrier can fly onto the photosensitive member. This is presumably because in case where the carrier particles are provided even partially with a thick coating resin layer, the carrier particles can retain a reverse polarity charge during triboelectrification of toner particles and can be attached to a non-image par t on the image-bearing member.

If the carrier core particles are surface-coated with a resin composition comprising a straight silicone resin and a coupling agent, it is possible to form a uniform coating layer while obviating coalescence of coated carrier particles during the resin coating or the peeling of the coating layer during a sufficient disintegration step. This is presumably related with an appropriate adhesion between the coating resin and the core, and appropriate hardness and surface energy of the silicone resin. It is particularly preferred to use a coupling agent having an amino group in an amount of 0.5–20 wt. % of the silicone resin and using a straight silicone resin including a trifunctional silicon or a combination of trifunctional and difunctional silicons in a trifunctional Si:difunctional Si atomic ratio of 100:0–40:60, more preferably 90:10–45:55, so as to adequately control the adhesion with the carrier core particles and the appropriate hardness of the crosslinked silicone resin, thereby providing an adequate coating.

It has been also found that a magnetic carrier having a broad particle size distribution and containing a large amount of fine powder results in an increased carrier attachment. For this reason, the magnetic coated carrier is designed to have a number-average particle size of 1–100 μm and a particle size distribution such that particles thereof having sizes in the range of at most a half of the number-average particle size are restricted to occupy at most 20% by number, so as to well prevent the carrier attachment.

The toner constituting the two-component type developer may preferably have a weight-average particle size of 1–10 μm and have a sharp particle size distribution such that particles having particle sizes of at most a half of the number-average particle size occupy at most 20% by number and particles having particle size of at least two times the weight-average particle size occupy at most 10% by volume. If a toner comprising toner particles prepared directly by a polymerization process and having a shape factor SF-1 of 100–140 is combined with a magnetic carrier having a shape factor SF-1 of 100–130 and containing little fine powder fraction, it is possible to obtain good images free from fog and having good dot reproducibility. This is presumably because, in the triboelectrification of a toner with a magnetic carrier, the resultant triboelectric charge distribution of the toner is narrowed by using a toner having a sharp particle size distribution, and the opportunity of contact between the toner and the carrier is equalized because the magnetic carrier particles have a uniform particle size. As a result, a more uniform triboelectrification becomes possible, so that the toner is provided with a sharp triboelectric charge distribution and the occurrence of a reverse toner fraction (i.e., a toner fraction charged in a reverse polarity) is minimized. As a result, also in the step of toner image transfer, a transfer failure due to a reverse polarity toner fraction is minimized, so that almost all the toner is transferred to a transfer material and a cleaner-less system requiring no cleaning member can be realized.

The durability of the carrier can be improved with minimization of carrier deterioration due to spent toner attachment and prevention of coating material peeling, if the carrier has a relatively low magnetization of 40–250 emu/$cm^3$, is coated with a resin composition comprising a straight silicone resin and a coupling agent, and is used in combination with toner particles formed through the polarization process and containing at most 1000 ppm of residual monomer. If individual carrier particles have a large magnetic force, when the developer is fed onto a developer-carrying member (i.e., a developing sleeve) under constraint by a magnetic force or when the developer contacts an electrostatic image-bearing member, the toner spending is liable to be promoted by the packing of the developer and the peeling of the coating material is promoted due to shearing between the carrier particles. Further, if the toner surface is soft, external additives such as inorganic particles and organic particles are liable to be embedded at the toner particle surface, and the carrier particle surface is liable to be soiled. The hardness of the toner particle surface is largely affected by the residual monomer content in the binder resin constituting toner particles. As a result of combination of these factors, it becomes possible to provide the developer with an improved durability by using a magnetic carrier having a low magnetic force, a reinforced carrier particle surface and an improved surface release characteristic together with toner particles formed through the polymerization process and a reduced residual monomer content of at most 1000 ppm.

Particularly, in the case of the magnetic material-dispersed resin carrier, in order to prevent the isolation or liberation of the magnetic material within the binder resin, it is effective to form carrier core particles comprising a thermosetting resin through a direct polymerization process and then surface-coat the carrier core particles with a resin composition comprising a straight silicone resin and a coupling agent. By using a coupling agent, preferably a coupling agent having an amino group together with a silicone resin, it is possible to well control the degree of crosslinking of the silicone resin and synergistically enhancing the core/coating adhesion to provide a tough carrier surface. Further, if the surface of the metal oxide dispersed in the binder is treated for imparting lipophilicity, the dispersibility of the metal oxide can be improved to provide an enhanced adhesion with the binder resin, thus effectively preventing the liberation of the metal oxide.

If the toner has a shape factor SF-1 of 100–140, the toner is less liable to cause filming on the photosensitive member surface even in repetitive continuous image formation. This is presumably because the toner transfer efficiency or transfer rate from the photosensitive member is kept stably high from the initial stage and during the continuous image formation. If the toner is substantially spherical, the toner particles are caused to have a smaller contact area with the photosensitive member than non-spherical indefinite shaped toner particles, so that the van der Waals force acting between the photosensitive member surface and the toner particles may become smaller, thus providing a higher toner transfer efficiency.

In order to be effectively used in a low-temperature fixation process, it is preferred that the toner particles have a core/shell structure and the core comprises a low-softening point substance having a melting point or softening point of 40°–90° C. Further, in order to obviate a developer deterioration during image formation on a large number of sheets, it is preferred to reduce the residual monomer content in the toner. In the case of toner particle principally comprising a binder resin, a colorant and a charge control agent, the residual monomer in the toner particles affects the thermal behavior of the toner particles around the glass transition point of the toner particles. As the residual monomer is a low-molecular weight component and functions to plasticize the entire toner particles, the external additives thereto are liable to be embedded during contact between the toner particles and the magnetic carrier. Accordingly, it is preferred to suppress the residual monomer content in the toner particles.

Further, in order to stably form a magnetic brush on the developer-carrying member without toner sticking, it is preferred to use a developer-carrying member provided with a surface unevenness for improved conveying power together with a developer comprising a toner and a magnetic carrier which are substantially spherical and have excellent flowability, so as to stir the developer to improve the developer flowability and suppress the packing of the developer downstream of the regulation member.

A smaller particle size of magnetic carrier is preferred from the viewpoint of a higher image quality but is liable to increase the carrier attachment based on a relation between the magnetic force and the particle size. From these viewpoints in combination, the magnetic carrier used in the present invention may have a number-average particle size in the range of 1–100 μm, preferably 15–50 μm, and the magnetic carrier has a magnetization of 50–200 emu/cm$^3$, so as to provide high image quality and prevent the carrier attachment. A carrier having a number-average particle size in excess of 100 μm is not preferred from the viewpoint of high image quality because the magnetic brush is liable to leave a rubbing trace on the photosensitive member surface. A carrier having a number-average particle size smaller than 1 μm is liable to cause the carrier attachment because of a small magnetic force per carrier particle.

It is important in the present invention that the magnetic carrier has a particle size distribution such that the carrier particles contain at most 20% by number of particles having sizes in the range of at most a half of the number-average particle size thereof. If the particles having sizes in the range of at most a half of the number-average particle size exceed 20% by number as an accumulative amount, the magnetic carrier is liable to cause an increased carrier attachment and have a poor charging ability to a toner. The method of measuring the particle size of magnetic carrier particles relied on herein will be described hereinafter.

As for the magnetic properties of the magnetic carrier used in the present invention, it is important to use a magnetic carrier having a magnetization of 40–250 emu/cm$^3$, preferably 50–230 emu/cm$^3$, respectively at 1 kilo-oersted. As has been described above, the magnetization of the magnetic carrier may be appropriately selected depending on the particle size of the carrier. While being also affected by the particle size, a magnetic carrier having a magnetization in excess of 250 emu/cm$^3$ is liable to result in a magnetic brush formed on a developer sleeve at developing pole having a low density and comprising long and rigid ears, thus being liable to result in rubbing traces in the resultant toner images and image defects, such as roughening of halftone images and irregularity of solid images, particularly due to deterioration in long continuous image formation on a large number of sheets, and further carrier attachment due to peeling of the carrier coating material. Below 40 emu/cm$^3$, the magnetic carrier is caused to exert only an insufficient magnetic force to result in a lower toner-conveying performance.

The magnetic properties referred to herein are values measured by using an oscillating magnetic field-type magnetic property auto-recording apparatus ("BHV-30", available from Riken Denshi K.K.). Specific conditions for the measurement will be described hereinafter.

The magnetic coated carrier of the present invention has an (electrical) resistivity of at least $1\times10^{12}$ ohm.cm at an electric field intensity of $5\times10^4$ V/m. If the resistivity is below $1\times10^{12}$ ohm.cm, the above-mentioned carrier attachment and image quality degradation in the process of developing electrostatic latent images are liable to be caused, thus failing to accomplish the objects of the present invention, such as provision of higher image quality and higher resolution. The method of measuring the resistivity of magnetic carrier powder referred to herein will be described hereinafter.

The magnetic carrier has a core having a resistivity of at least $1\times10^{10}$ ohm.cm at an electric field intensity of $5\times10^{14}$ V/m. If the resistivity is below $1\times10^{10}$ ohm.cm, even a coated carrier is liable to cause charge injection and charge leakage from an electrostatic image when the core is even partly exposed, thus being liable to cause carrier attachment.

The core of the magnetic carrier may preferably comprise magnetite or ferrite showing magnetism as represented by a general formula of $MO.Fe_2O_3$ or $MFe_2O_4$, wherein M denotes a divalent or monovalant metal, such as Ca, Mn, Fe, Ni, Co, Cu, Mg, Zn, Cd, or Li. M denotes a single species or plural species of metals. Specific examples of the magnetite or ferrite may include: iron-based oxide materials, such as magnetite, γ-iron oxide, Mn—Zn—Fe-based ferrite, Ni—Zn—Fe-based ferrite, Mn—Mg—Fe-based ferrite, Ca—Mn—Fe-based ferrite, Ca—Mg—Fe-based ferrite, Li—Fe-based ferrite, and Cu—Zn—Fe-based ferrite. Among these, magnetite is most preferably used.

The carrier core can consist of an iron-based metal oxide as described above alone. In this instance, however it is necessary to increase the resistivity to $1\times10^{10}$ ohm.cm or higher, e.g., by intensely oxidizing the core surface. A more preferred form of carrier may comprise a carrier core obtained by dispersing a metal oxide as described above in a resin. In this instance, it is possible to disperse a single species of metal oxide in the resin, but it is particularly preferred to disperse at least two species of metal oxides in mixture in the resin. In the latter case, it is preferred to use plural species of particles having similar specific gravities and/or shapes in order to provide an increased adhesion and a high carrier strength. A preferred type of combination of plural species of metal oxides is a combination of fine particles of a magnetic metal oxide (preferably an iron-based one as described above) and fine particles of a non-magnetic metal oxide.

Examples of such non-magnetic metal oxide may include: non-magnetic metal oxides including one or plural species of metals, such as Mg, Al, Si, Ca, Sc, Ti, V, Cr, Mn, Fe, Co, Ni, Cu, Zn, Sr, Y, Zr, Nb, Mo, Cd, Sn, Ba and Pb. Specific examples of non-magnetic metal oxides may include: $Al_2O_3$, $SiO_2$, CaO, $TiO_2$, $V_2O_5$, $CrO_2$, $MnO_2$, $\alpha$-$Fe_2O_3$, CoO, NiO, CuO, ZnO, SrO, $Y_2O_3$ and $ZrO_2$.

A further preferred type of combination of plural species of metal oxides may include a combination of a low-resistivity magnetic metal oxide and a high-resistivity magnetic or non-magnetic metal oxide. A combination of a low-resistivity magnetic metal oxide and a high-resistivity non-magnetic metal oxide is particularly preferred.

Examples of preferred combination may include: magnetite and hematite ($\alpha$-$Fe_2O_3$), magnetite and $\gamma$-$Fe_2O_3$, magnetite and $SiO_2$, magnetite and $Al_2O_3$, magnetite and $TiO_2$, magnetite and Ca—Mn—Fe-based ferrite, and magnetite and Ca—Mg—Fe-based ferrite. Among these, the combination of magnetite and hematite is particularly preferred.

In the case of dispersing the above-mentioned metal oxide in a resin to provide core particles, the metal oxide showing magnetism may preferably have a number-average particle size of 0.02–2 μm. In the case of dispersing two or more species of metal oxides in combination, a metal oxide showing magnetism and having a generally lower resistivity may preferably have a number-average particle size ra of 0.02–2 μm, and another metal oxide preferably having a higher resistivity than the magnetic metal oxide (which may be non-magnetic) may preferably have a number-average particle size rb of 0.05–5 μm. In this instance, a ratio rb/ra may preferably exceed 1.0 and be at most 5.0. A ratio rb/ra of 1.2–5 is further preferred. If the ratio is 1.0 or below, it is difficult to form a state that the metal oxide particles having a higher resistivity are exposed to the core particle surface, so that it becomes difficult to sufficiently increase the core resistivity and obtain an effect of preventing the carrier attachment. On the other hand, if the ratio exceeds 5.0, it becomes difficult to disperse the metal oxide particles in the resin, thus being liable to result in a lower magnetic carrier strength and liberation of the metal oxide. The method of measuring the particle size of metal oxides referred to herein will be described hereinafter.

Regarding the metal oxides dispersed in the resin, the magnetic particles may preferably have a resistivity of at least $1\times10^3$ ohm.cm, more preferably at least $1\times10^5$ ohm.cm. Particularly, in the case of using two or more species of metal oxides in mixture, magnetic metal oxide particles may preferably have a resistivity of at least $1\times10^3$ ohm.cm, and preferably non-magnetic other metal oxide particles may preferably have a resistivity higher than that of the magnetic metal oxide particles. More preferably, the other metal oxide particles may have a resistivity of at least $10^8$ ohm.cm. If the magnetic metal oxide particles have a resistivity below $1\times10^3$ ohm.cm, it is difficult to have a desired resistivity of carrier even if the amount of the metal oxide dispersed is reduced, thus being liable to cause charge injection leading to inferior image quality and invite the carrier attachment. In the case of dispersing two or more metal oxides, if the metal oxide having a larger particle size has a resistivity below $1\times10^8$ ohm.cm, it becomes difficult to sufficiently increase the carrier core resistivity, thus being difficult to accomplish the object of the present invention. The method of measuring resistivities of metal oxides referred to herein will be described hereinafter.

The metal oxide-dispersed resin core used in the present invention may preferably contain 50–99 wt. % of the metal oxide. If the metal oxide content is below 50 wt. %, the charging ability of the resultant magnetic carrier becomes unstable and, particularly in a low temperature-low humidity environment, the magnetic carrier is charged and is liable to have a remanent charge, so that fine toner particles and an external additive thereto are liable to be attached to the surfaces of the magnetic carrier particles. In excess of 99 wt. %, the resultant carrier particles are caused to have an insufficient strength and are liable to cause difficulties of carrier particle breakage and liberation of metal oxide fine particles from the carrier particles during a continuous image formation.

As a further preferred embodiment of the present invention, in the metal oxide-dispersed resin core containing two or more species of metal oxides dispersed therein, the magnetic metal oxide may preferably occupy 30–95 wt. % of the total metal oxides. A content of below 30 wt. % may be preferred to provide a high-resistivity core, but results in a carrier exerting a small magnetic force, thus inviting the carrier attachment in some cases. Above 95 wt. %, it becomes difficult to increase the core resistivity.

It is further preferred that the metal oxide contained in the metal oxide-dispersed resin has been subjected to a lipophilicity-imparting treatment so as to prevent the liberation of the metal oxide particles. In the step of dispersion in a binder resin to form core particles, a lipophilicity-imparted metal oxide can be taken in the binder resin uniformly and at a high density. This is particularly important in preparation of core particles through the polymerization process, so as to obtain spherical and smooth-surfaced particles.

The lipophilicity-imparting treatment may preferably be performed as a surface-treatment with a coupling agent, such as a silane coupling agent, a titanate coupling agent or an aluminum coupling agent, or a surfactant.

It is particularly preferred to effect a surface-treatment with a coupling agent, such as a silane coupling agent or a titanate coupling agent.

The silane coupling agent may have a hydrophobic group, an amino group or an epoxy group. Examples of silane coupling agent having a hydrophobic group may include: vinyltrichlorosilane, vinyltriethoxysilane, and vinyltris($\beta$-methoxy)silane. Examples of silane coupling agent having an amino group may include: $\gamma$-aminopropyltrimethoxysilane, $\gamma$-aminopropylmethoxydiethoxysilane, $\gamma$-aminopropyltriethoxysilane, N-$\beta$-aminoethyl-$\gamma$-aminopropyltrimethoxysilane, N-$\beta$-aminoethyl-$\gamma$-aminopropylmethyldimethoxysilane, and N-phenyl-$\gamma$-aminopropyltrimethoxysilane. Examples of silane coupling agent having an epoxy group may include: $\gamma$-glycidoxypropylmethyldiethoxysilane, $\gamma$-glycidoxypropyltriethoxysilane, and $\beta$-(3,4-epoxycyclohexyl)trimethoxysilane.

Examples of titanate coupling agent may include: isopropyltriisostearoyl titanate, isopropyltridodecylbenzenesulfonyl titanate, and isopropyltris(dioctylpyrophosphate) titanate.

The binder resin constituting the metal oxide-dispersed resin core used in the present invention may comprise a vinyl resin; a non-vinyl condensation type resin, such as polyester resin, epoxy resin, phenolic resin, urea resin, polyurethane resin, polyimide resin, cellulosic resin or polyether resin; or a mixture of such a non-vinyl resin and a vinyl resin.

Examples of vinyl monomer for providing the vinyl resin may include: styrene; styrene derivatives, such as o-methylstyrene, m-methylstyrene, p-methylstyrene, p-phenylstyrene, p-ethylstyrene, 2,4-dimethylstyrene, p-n-butylstyrene, p-tertbutylstyrene, p-n-hexylstyrene, p-n-octylstyrene, p-nnonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; ethylenically unsaturated monoolefins, such as ethylene, propylene, butylene and isobutylene; unsaturated polyenes, such as butadiene and isoprene; halogenated vinyls, such as vinyl chloride, vinylidene chloride, vinyl bromide, and vinyl fluoride; vinyl esters, such as vinyl acetate, vinyl propionate, and vinyl benzoate methacrylic acid; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acid; acrylates, such as methyl acrylate, ethyl acrylate, n-butyl acrylate, isobutyl acrylate, propyl acrylate, n-octyl acrylate, dodecyl acrylate, 2-ethylhexyl acrylate,antearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; and acrolein. These may be used singly or in mixture of two or more species to form a vinyl resin.

In producing the magnetic metal oxide-dispersed core particles, starting materials including a thermoplastic resin, magnetic metal oxide particles and other additives may be sufficiently blended by a blender, and melt-kneaded through kneading means, such as hot rollers, a kneader or an extruder, followed by cooling, pulverization and classification to obtain carrier core particles. The resultant resinous core particles may preferably be spherized (i.e., made spherical) thermally or mechanically to provide spherical core particles.

In addition to the above-mentioned process including melt-kneading and pulverization, the magnetic metal oxide-dispersed core particles may also be prepared by subjecting a mixture of a monomer and metal oxide particles to polymerization to directly provide carrier core particles. Examples of the monomer used for the polymerization may include the above-mentioned vinyl monomers, a combination of a bisphenol or a derivative thereof and epichlorohydrin for producing epoxy resins; a combination of a phenol and an aldehyde for producing phenolic resins; a combination of urea and an aldehyde for producing a urea resin; and a combination of melamine and an aldehyde. For example, a carrier core including cured phenolic resin may be produced by subjecting a phenol and an aldehyde in mixture with a metal oxide as described above, and optionally a dispersion stabilizer, to polycondensation in the presence of a basic catalyst in an aqueous medium. Alternatively, it is also possible to produce core particles by subjecting a phenol and an aldehyde together with a lipophilicity-imparted metal oxide to polycondensation in the presence of a basic catalyst in an aqueous medium. In order to adjust the resistivity of the core particles or prevent the liberation of the metal oxide particles, it is also possible to coat the core particles once obtained as described above with a resin identical to the binder resin or a mixture thereof with a metal oxide, e.g., by a further polymerization, before the coating with a silicone resin.

It is also possible to crosslink the binder resin so as to increase the strength of the carrier core particles. The crosslinking may be effected, e.g., by performing the melt-kneading in the presence of a crosslinking component to cause crosslinking in the melt-kneading step, by performing the direct polymerization while using a curable-type resin to obtain cured core particles or using a polymerizable composition containing a crosslinking component.

It is essential that the carrier core particles are coated with a silicone resin composition containing a straight silicone resin, i.e., a silicone resin formed by only organosiloxane units represented by the following formulae 1 and 2:

Formula 1 di-functional silicon-containing organosiloxane unit

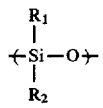

Formula 2 trifunctional silicon-containing organosiloxane unit

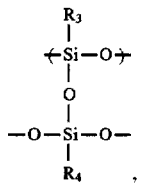

wherein $R_1$, $R_2$, $R_3$ and $R_4$ independently denote hydrogen atom, methyl group, phenyl group or hydroxyl groups which may also constitute a terminal group of the straight silicone resin. It is preferred that $R_1$, $R_2$, $R_3$ and $R_4$ are all methyl groups, a portion of which can be replaced with phenyl group. Non-straight silicone resins modified by replacement with another functional group or another resin is liable to cause the deposition of spent toner due to an increase in surface energy and/or a lowering in hardness.

The silicon atoms contained in the organosiloxane units represented by the formulae 1 and 2 are tri-functional silicon (i.e., a silicon atom connected to three oxygen atoms) and/or trifunctional silicon and di-functional silicon (i.e., a silicon atom connected to two oxygen atoms). It is preferred that trifunctional silicon and difunctional silicon are contained in a ratio of 100:0–50:50 in the straight silicone resin so as to provide a preferable coating film hardness.

It is preferred that 100 wt. parts of the carrier core particles are coated with 0.05–10 wt. parts, more preferably 0.2–5 wt. parts, of a silicone resin composition comprising a straight silicone resin and a coupling agent.

If the coating amount is below 0.05 wt. part, it is difficult to sufficiently coat the carrier core particles, thus being liable to fail in sufficiently suppressing the spent toner deposition in a continuous image formation. In excess of 10 wt. parts, because of excessive resin coating amount, the resistivity may be held within a desired range, but the flowability can be lowered or carrier attachment can be caused due to charge accumulation.

In the magnetic coated carrier according to the present invention, the exposure density of the metal oxide may preferably be controlled at 0.1–10 particles/$\mu m^2$ so as to well control the carrier charge accumulation. The method for determination of the exposure density of metal oxide at the coated carrier particle surface will be described later.

The coupling agent used together with the silicone resin may for example be a silane coupling agent, a titanate coupling agent or an aluminum coupling agent. The silane coupling agent may have a hydrophobic group, an amino group or an epoxy group.

Examples of the hydrophobic group may include alkyl group, alkenyl group, halogenated alkyl group, halogenated alkenyl group, phenyl group, halogenated phenyl group, or alkyl phenyl group. A preferred class of silane coupling agents having a hydrophobic group may be those represented by the following formula: $R_mSiY_n$, wherein R denotes an alkoxy group, Y denotes an alkyl or vinyl group, and m and n are integers of 1–3.

Preferred examples of the silane coupling agent having a hydrophobic group may include: vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy)silane.

It is also possible to use a silane coupling agent having a hydrophobic group selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

Examples of silane coupling agent having an amino group may include: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl-γ-aminopropyltrimethoxysilane.

Examples of silane coupling agent having an epoxy group may include: γ-glycidoxypropylmethyldiethoxysilane, γ-glycidoxypropyltriethoxysilane, and β-(3,4-epoxycyclohexyl)trimethoxysilane.

Examples of titanate coupling agent may include: isopropyltriisostearoyl titanate, isopropyltridodecylbenzenesulfonyl titanate, isopropyltris(dioctylpyrophosphate) titanate, isopropyltri(N-aminoethyl-aminoethyl)titanate, and isopropyl-4-aminobenzene-sulfonyl-di(dodecylbenzenesulfonyl)titanate.

The aluminum coupling agent may for example be acetoalkoxyaluminum diisopropylate.

As the coupling agent to be used together with the silicone resin, it is particularly preferred to use a coupling agent having an amino group. If a resin composition containing at least one species of amino group-containing coupling agent, it is possible to well control the crosslinking degree and triboelectrification characteristic of the coating resin. It is also possible to use a curing agent in addition to a coupling agent in order to control the hardness.

The curing agent may comprise an organometal salt, as represented by an organotin-based curing agent, or an amine-based catalyst.

The magnetic coated carrier may preferably be produced through by spraying a coating resin solution onto carrier core particles in a floating or fluidized state to form a coating film on the core particle surfaces, or spray drying. This coating method may suitably be used for coating the magnetic carrier-dispersed resin core particles with a thermoplastic resin.

Other coating methods may include gradual evaporation of the solvent in a coating resin solution in the presence of a metal oxide under application of a shearing force.

The coating of the silicone resin composition may preferably be subjected to curing, preferably be heating at a temperature of at least 150° C. for more than a half hour, so as to provide an increased film strength.

The magnetic coated carrier according to the present invention is designed to be substantially spherical in shape as represented by a shape factor SF-1 in the range of 100–130. If SF-1 exceeds 130, the resultant developer is caused to have a poor fluidity and provides a magnetic brush of an inferior shape, so that it becomes difficult to obtain high-quality toner images. The shape factor SF-1 of a carrier may be measured, e.g., by sampling at least 300 carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

$$SF\text{-}1=[(MX\ LNG)^2/\mathrm{AREA}]\times\pi/4\times100,$$

wherein MX LNG denotes the maximum diameter of a carrier particle, and AREA denotes the projection area of the carrier particle.

The toner used in the present invention may have a weight-average particle size (D4) of 1–10 μm, preferably 3–8 μm. Further, in order to effect good triboelectrification free from occurrence of reverse charge fraction and good reproducibility of latent image dots, it is preferred to satisfy such a particle size distribution that the toner particles contain at most 20% by number in accumulation of particles having particle sizes in the range of at most a half of the number-average particle size (D1) thereof and contain at most 10% by volume in accumulation of particles having particle sizes in the range of at least two times the weight-average particle size (D4) thereof. In order to provide a toner with further improved triboelectric chargeability and dot reproducibility, it is preferred that the toner particles contain at most 15% by number, further preferably at most 10% by number, of particles having sizes of at most ½×D1, and at most 5% by volume, further preferably at most 2% by volume of particles having sizes of at least 2×D4.

If the toner has a weight-average particle size (D4) exceeding 10 μm, the toner particles for developing electrostatic latent images become so large that development faithful to the latent images cannot be performed even if the magnetic force of the magnetic carrier is lowered, and extensive toner scattering is caused when subjected to electrostatic transfer. If D4 is below 1 μm, the toner causes difficulties in powder handling characteristic.

If the cumulative amount of particles having sizes of at most a half of the number-average particle size (D1) exceeds 20% by number, the triboelectrification of such fine toner particles cannot be satisfactorily effected to result in difficulties, such as a broad triboelectric charge distribution of the toner, charging failure (occurrence of reverse charge fraction) and a particle size change during continuous image formation due to localization of toner particle sizes. If the cumulative amount of particles having sizes of at least two times the weight-average particle size (D4) exceeds 10% by volume, the triboelectrification with the metal oxide becomes difficult, and faithful reproduction of latent images becomes difficult. The toner particle size distribution may be measured, e.g., by using a laser scanning-type particle size distribution meter (e.g., "CIS-100", available from GALIA Co.).

The particle size of the toner used in the present invention is closely associated with the particle size of the magnetic carrier. A toner weight-average particle size of 9–10 μm is desired in order to provide a better chargeability and high-quality image formation, when the magnetic carrier has a number-average particle size of 36–100 μm. On the other hand, when the magnetic carrier has a number-average particle size of 5–35 μm, it is preferred that the toner has a weight-average particle size of 1–8 μm in order to prevent the developer deterioration and high-quality image formation at initial stage and particularly in continuous image formation.

The toner may preferably have a low residual monomer content of at most 500 ppm, further preferably at most 300 ppm so as to provide good continuous image forming characteristic and good quality images. The method of determining the residual monomer content in a toner will be described later.

The toner may preferably a shape factor SF-1 of 100–140, more preferably 100–130. This is particularly effective in a simultaneous developing and cleaning system or a cleaner-less image forming system. The shape factor SF-1 of a toner may be measured, e.g., by sampling 100 enlarged toner images (at a magnification of 200–5000) at random through a field-emission scanning electron microscope ("S-800", available from Hitachi Seisakusho K.K.) and introducing the image data to an image analyzer ("Luzex 3", available from Nireco K.K.) for calculation according to the following scheme:

$$SF\text{-}1=[(MX\ LNG)^2/\mathrm{AREA}]\times\pi/4\times100,$$

wherein MX LNG denotes the maximum diameter of a toner particles, and AREA denotes the projection area of the toner particles.

The shape factor SF-1 represents a sphericity, and SF-1 exceeding 140 means an indefinite shape different from a sphere. If the toner has a SF-1 exceeding 140, the toner is liable to provide a lower toner transfer efficiency from a photosensitive member to a transfer material and leave much residual toner on the photosensitive member. In this regard, toner particles prepared directly through a polymerization process may have a shape factor SF-1 close to 100 and have a smooth surface. Because of the surface smoothness, an electric field concentration occurring at the surface unevennesses of the toner particles can be alleviated to provide an increased transfer efficiency or transfer rate.

The toner particles used in the present invention may preferably have a core/shell structure (or a pseudo-capsule structure). Such toner particles having a core/shell structure may be provided with a good anti-blocking characteristic without impairing the low-temperature fixability. Compared with a bulk polymerization toner having no core structure, a toner having a core/shell structure prepared by forming a shell enclosing a core of a low-softening point substance through polymerization allows easier removal of the residual monomer from the toner particles in a post-treatment step after the polymerization step.

It is preferred that the core principally comprises a low-softening point substance. The low-softening point substance may preferably comprise a compound showing a main peak at a temperature within a range of 40°–90° C. on a heat-absorption curve as measured according to ASTM D3418-8. If the heat-absorption main peak temperature is below 40° C., the low-softening point substance is liable to exhibit a low self-cohesion leading to a weak anti-high temperature offset characteristic. On the other hand, if the heat-absorption peak temperature is above 90° C., the resultant toner is liable to provide a high fixation temperature. Further, in the case of toner particle preparation through the direct polymerization process including particle formation and polymerization within an aqueous medium, if the heat-absorption main peak temperature is high, the low-softening point substance is liable to precipitate during particle formation of a monomer composition containing the substance within an aqueous medium.

The heat-absorption peak temperature measurement may be performed by using a scanning calolimeter ("DSC-7", available from Perkin-Elmer Corp.). The temperature correction for the detector of the apparatus may be made based on the melting points of indium and zinc, and the heat quantity correction may be made based on the melting heat of indium. A sample is placed on an aluminum-made pan, and a blank pan is also set as a control, for measurement a temperature-raising rate of 10° C./min. The measurement may be performed in a temperature range of 30°–160° C.

Examples of the low-softening point substance may include: paraffin wax, polyolefin wax, Fischer-Tropsche wax, amide wax, higher fatty acid, ester wax, and derivatives and graft/or block copolymerization products of these waxes.

The low-softening point substance may preferably be added in a proportion of 5–30 wt. % of the toner particles. Below 5 wt. %, a large load is required for reducing the residual monomer. In excess of 30 wt. %, the coalescence of particles of the polymerizable monomer composition during toner particle production through the polymerization process is liable to occur to result in a broad particle size distribution.

The toner particles may suitably be blended with an external additive. If the toner particles are coated with such an external additive, the external additive is caused to be present between the toner particles and between the toner and carrier, thereby providing an improved flowability and an improved life of the developer. It is preferred that 5–99%, more preferably 10–99%, of the toner particle surface is coated with the external additive.

The external additive may for example comprise powder of materials as follows: metal oxides, such as aluminum oxide, titanium oxide, strontium titanate, cerium oxide, magnesium oxide, chromium oxide, tin oxide, and zinc oxide; nitrides, such as silicon nitride carbides, such as silicon carbide; metal salts, such as calcium sulfate, barium sulfate, and calcium sulfate; aliphatic acid metal salts such as zinc stearate, and calcium stearate; carbon black, silica, polytetrafluoroethylene, polyvinylidene fluoride, polymethyl methacrylate, polystyrene, and silicone resin. These powders may preferably have a number-average particle size (D1) of at most 0.2 μm. If the average particle size exceeds 0.2 μm, the toner is caused to have a lower flowability, thus resulting in lower image qualities due to inferior developing and transfer characteristic.

Such an external additive may be added in an amount of 0.01–10 wt. parts, preferably 0.05–5 wt. parts, per 100 wt. parts of the toner particles. Such external additives may be added singly or in combination of two or more species. It is preferred that such external additives have been hydrophobized (i.e., subjected to hydrophobicity-imparting treatment).

The toner surface coverage with an external additive may be determined by taking 100 toner particle images enlarged at a magnification of 5000–20000 and selected at random by observation through a filled-emission scanning electron microscope (FE-SEM) ("S-800", available from Hitachi Seisakusho K.K.) and introducing the image data via an interface into an image analyzer "Luzex 3", available from Nireco K.K.) to determine a percentage of area covered with external additive particles of a toner particle area on a two-dimensional image basis.

The external additive may preferably have a specific surface area of at least 30 $m^2/g$, particularly 50–400 $m^2/g$ as measured by the BET method according to nitrogen adsorption.

The toner particles and the external additive may be mixed with each other by means of a blender, such as a Henschel mixer. The resultant toner may be blended with carrier particles to form a two-component type developer. While depending on a particular developing process used, the two-component type developer may preferably contain 1–20 wt. %, more preferably 1–10 wt. %, of the toner. The toner in the two-component type developer may preferably have a triboelectric charge of 5–100 μC/g, more preferably 5–60 μC/g. The method for measuring the toner triboelectric charge will be described later.

The toner particles may for example be produced through a suspension polymerization process for directly producing toner particles, a dispersion polymerization process for directly producing toner particles in an aqueous organic solvent medium in which a monomer is soluble but the resultant polymer is insoluble, or an emulsion polymerization process, as represented by a soap-free polymerization process, for directly producing toner particles by polymerization in the presence of a water-soluble polar polymerization initiator.

The suspension polymerization under normal pressure or an elevated pressure may particularly preferably be used in the present invention because an SF-1 of the resultant toner particles can readily be controlled in a range of 100–140 and fine toner particles having a sharp particle size distribution and a weight-average particle size of 4–8 μm can be obtained relatively easily.

An enclosed structure of the low-softening point substance in the toner particles may be obtained through a process wherein the low-softening point substance is selected to have a polarity in an aqueous medium which polarity is lower than that of a principal monomer component and a small amount of a resin or monomer having a larger polarity is added thereto, to provide toner particles having a core-shell structure. The toner particle size and its distribution may be controlled by changing the species and amount of a hardly water-soluble inorganic salt or a dispersant functioning as a protective colloid; by controlling mechanical apparatus conditions, such as a rotor peripheral speed, a number of pass, and stirring conditions inclusive of the shape of a stirring blade; and/or by controlling the shape of a vessel and a solid content in the aqueous medium.

The outer shell resin of toner particles, may comprise styrene-(meth)acrylate copolymer, or styrene-butadiene copolymer. In the case of directly producing the toner particles through the polymerization process, monomers of these resins may be used.

Specific examples of such monomers may include: styrene and its derivatives such as styrene, o-, m- or p-methylstyrene, and m- or p-ethylstyrene; (meth)acrylic acid esters such as methyl (meth)acrylate, ethyl (meth) acrylate, propyl (meth)acrylate, butyl (meth)acrylate, octyl (meth)acrylate, dodecyl (meth)acrylate, 2-ethylhexyl (meth) acrylate, stearyl (meth)acrylate, behenyl (meth)acrylate, dimethylaminoethyl (meth)acrylate, and diethylaminoethyl (meth)acrylate; butadiene; isoprene; cyclohexene; (meth) acrylonitrile, and acrylamide.

These monomers may be used singly or in mixture of two or more species so as to provide a theoretical glass transition point (Tg), described in "POLYMER HANDBOOK", second addition, III-pp. 139–192 (available from John Wiley & Sons Co.), of 40°–75° C. If the theoretical glass transition point is below 40° C., the resultant toner particles are liable to have lower storage stability and durability. On the other hand, if the theoretical glass transition point is in excess of 75° C., the fixation temperature of the toner particles is increased, whereby respective color toner particles are liable to have an insufficient color-mixing characteristic particularly in the case of the full-color image formation.

In the present invention, the molecular-weight distribution of THF-soluble content of the outer shell resin may be measured by bel permeation chromatography (GPC) as follows. In the case of toner particles having a core-shell structure, the toner particles are subjected to extraction with toluene for 20 hours by means of Soxhlet extractor in advance, followed by distilling-off of the solvent (toluene) to obtain an extract. An organic solvent (e.g., chloroform) in which a low-softening point substance is dissolved and an outer resin is not dissolved is added to the extract and sufficiently washed therewith to obtain a residue product. The residue product is dissolved in tetrahydrofuran (THF) and subjected to filtration with a solvent-resistant membrane filter having a pore size of 0.3 μm to obtain a sample solution (THF solution). The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples.

In the present invention, the THF-soluble content of the outer shell resin may preferably have a number-average molecular weight (Mn) of 5,000–1,000,000 and a ratio of weight-average molecular weight (Mw) to Mn (Mw/Mn) of 2–100.

In order to enclose the low-softening point compound in the outer resin (layer), it is particularly preferred to add a polar resin. Preferred examples of such a polar resin may include styrene-(meth)acrylic acid copolymer, styrene-maleic acid copolymer, saturated polyester resin and epoxy resin. The polar resin may particularly preferably have no unsaturated group capable of reacting with the outer resin or a vinyl monomer constituting the outer resin. This is because if the polar resin has an unsaturated group, the unsaturated group can cause crosslinking reaction with the vinyl monomer, thus resulting in an outer resin having a very high molecular weight, which is disadvantageous because of a poor color-mixing characteristic.

The toner particles having an outer shell structure can further be surface-coated by polymerization to have an outermost shell resin layer.

The outermost shell resin layer may preferably be designed to have a glass transition temperature which is higher than that of the outer shell resin layer therebelow and be crosslinked within an extent of not adversely affecting the fixability, in order to provide a further improved anti-blocking characteristic.

The method for providing such an outer shell resin layer is not particularly restricted but examples thereof may include the following:

(1) In the final stage of or after completion of the above-mentioned polymerization, a monomer composition containing optionally therein a color resin, a charge control agent or a crosslinking agent dissolved or dispersed therein is added to the polymerization system to have the polymerizate particles adsorb the monomer composition, and the system is subjected to polymerization in the presence of a polymerization initiator.

(2) Emulsion polymerizate particles or soap-free polymerizate particles formed from a monomer composition containing optionally a polar resin, a charge control agent or a crosslinking agent, are added to the polymerization system to be agglomerated onto the already present polymerizate particles, optionally followed by heating to be securely attached.

(3) Emulsion polymerizate particles or soap-free polymerizate particles formed from a monomer composition containing optionally a polar resin, a charge control agent or a crosslinking agent, are mechanically attached securely to the previously formed polymerizate or toner particles in a dry system.

The colorant used in the present invention may include a black colorant, yellow colorant, a magenta colorant and a cyan colorant.

Examples of non-magnetic black colorant may include: carbon black, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, transparency of the resultant OHP film, and a dispersibility in toner particles. The above colorants may preferably be used in a proportion of 1–20 wt. parts per 100 wt. parts of the binder resin.

A black colorant comprising a magnetic material, unlike the other colorants, may preferably be used in a proportion of 40–150 wt. parts per 100 wt. parts of the binder resin.

The charge control agent may be used in the present invention including known charge control agents. The charge control agent may preferably be one which is colorless and has a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent may be those of negative-type or positive-type. Specific examples of the negative charge control agent may include: metal compounds organic acids, such as salicylic acid, dialkylsalicylic acid, naphtoic acid, dicarboxylic acid and derivatives of these acids; polymeric compounds having a side chain comprising sulfonic acid or carboxylic acid; borate compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent may preferably be used in a proportion of 0.5–10 wt. parts per 100 wt. parts of the binder resin. However, the charge control agent is not an essential component for the toner particles used in the present invention.

Examples of the polymerization initiator usable in the direct polymerization may include: azo-type polymerization initiators, such as 2,2'-azobis(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while making reference to 10-hour half-life period temperature. In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–10 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may also be produced by direct polymerization in the following manner. Into a polymerizable monomer, a low-softening point substance (release agent), a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a latter stage of the polymerization. It is also possible to subject a part of the aqueous system to distillation in a latter stage of or after the polymerization in order to remove the yet-polymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

The toner particles can be further subjected to classification for controlling the particle size distribution. For example, it is preferred to use a multi-division classifier utilizing the Coanda effect according to a Coanda block so as to effectively produce toner particles having a desired particle size distribution.

The developing method according to the present invention may for example be performed by using a developing device as shown in FIG. 1. It is preferred to effect a development in a state where a magnetic brush formed of a developer contacts a latent image-bearing member, e.g., a photosensitive drum 3 under application of an alternating electric field. A developer-carrying member (developing sleeve) 1 may preferably be disposed to provide a gap B of 100–1000 μm from the photosensitive drum 3 in order to prevent the carrier attachment and improve the dot reproducibility. If the gap is narrower than 100 μm, the supply of the developer is liable to be insufficient to result in a low image density. In excess of 1000 μm, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. Particularly, as the toner particle size is reduced, it is preferred to decrease the duty of a voltage component ($V_{forward}$) for producing toner transfer to the image-bearing member. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using the two-component type developer according to the present invention, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 1 with the photosensitive drum 3 at 3–8 mm in order to effect a development providing a sufficient image density and excellent dot reproducibility without causing carrier attachment. If the developing nip C is between 3–8 mm, it becomes possible to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 2 and the developing sleeve 1 and/or changing the gap B between the developing sleeve 1 and the photosensitive drum 3.

The developer-carrying member used in the present invention may preferably satisfy the following surface state conditions: 0.2 μm≦center line-average roughness (Ra)≦5.0 μm, 10 μm≦average unevenness spacing (Sm)≦80 μm and 0.05≦Ra/Sm≦0.5.

The parameters Ra and Sm refer to a center line-average roughness and an average unevenness spacing defined by JIS B0601 (and ISO 468) and obtained by the following formula:

$$Ra = (1/l)\int_0^l |f(x)|dx$$

$$Sm = (1/n)\sum_{i=1}^{n} Smi$$

If Ra is below 0.2 μm, the developer-carrying member shows an insufficient developer-conveying ability so that an image density irregularity is liable to be caused particularly in a continuous image formation. If Ra exceeds 5 μm, the developer-carrying member is excellent in toner-conveying ability but exerts too large a constraint force at a developer conveying regulation zone as by a regulating blade to cause deterioration by rubbing of an external additive to the toner particle surfaces, thus being liable to cause a lowering in image quality during a successive image formation.

If Sm exceeds 80 μm, the retention of a developer on the developer-carrying member becomes difficult to result in a lower image density. The mechanism thereof has not been fully clarified as yet but, in view of a phenomenon that a slippage of developer on the developer-carrying member is caused at the conveyance regulating zone of the developer-carrying member, it is assumed that the developer is densely packed to form a cake in case of too large an unevenness spacing and a force acting on the cake exceeds a retention force acting between the toner-developer-carrying member, thus resulting in a lower image density. If Sm is below 10 μm, many of unevennesses on the developer-carrying member become smaller than the average particle size of the developer, so that a particle size selection of developer entering the concavities occurs, thus being liable to cause melt-sticking of the developer fine powder fraction. Further, the production of the developer-carrying member is not easy.

In further view of the above-described points, an unevenness slope (=f(Ra/Sm)) obtained from a convexity height and an unevenness spacing on the developer-carrying member may preferably satisfy a relationship of $0.5 \geqq Ra/Sm \geqq 0.05$, more preferably $0.3 \geqq Ra \geqq 0.07$.

If Ra/Sm is below 0.05, the developer-carrying member shows too small a toner-retention force so that the retention of toner on the developer-carrying member becomes difficult and the conveyance to the developer regulation zone is not controlled, whereby an image density irregularity is liable to be caused. If Ra/Sm exceeds 0.5, the toner entering the concavities is not mixed circulatively with the other toner, so that the toner melt-sticking is liable to occur.

The values of Ra and Sm described herein are based on those measured according to JIS-B0601 by using a contact-type surface roughness tester ("SE-3300", mfd. by Kosaka Kenkyusho K.K.) by using a measurement length l of 2.5 mm and effecting measurement at arbitrarily selected several points on the surface of a developer-carrying member.

A developer-carrying member (sleeve) may be provided with a prescribed surface roughness, e.g., by sand blasting with abrasive particles comprising irregularly shaped or regularly shaped particles, rubbing of the sleeve with sand paper in directions in parallel with the axis thereof (i.e., directions perpendicular to the developer-conveying direction) for providing unevenness preferentially formed in the circumferential direction, chemical treatment, and coating with a resin followed by formation of resinous projections.

The developer-carrying member used in the present invention may be composed of a known material, examples of which may include: metals, such as aluminum, stainless steel, and nickel; a metal body coated with carbon, a resin or an elastomer; and elastomer, such as natural rubber, silicone rubber, urethane rubber, neoprene rubber, butadiene rubber and chloroprene rubber in the form of an unfoamed, or foamed or sponge form, optionally further coated with carbon, a resin or an elastomer.

The developer-carrying member used in the present invention may assume a shape of a cylinder or a sheet.

In order to provide full color images giving a clearer appearance, it is preferred to use four developing devices for magenta, cyan, yellow and black, respectively, and finally effect the black development.

An image forming apparatus suitable for practicing full-color image forming method according to the present invention will be described with reference to FIG. 3.

Figure 3:
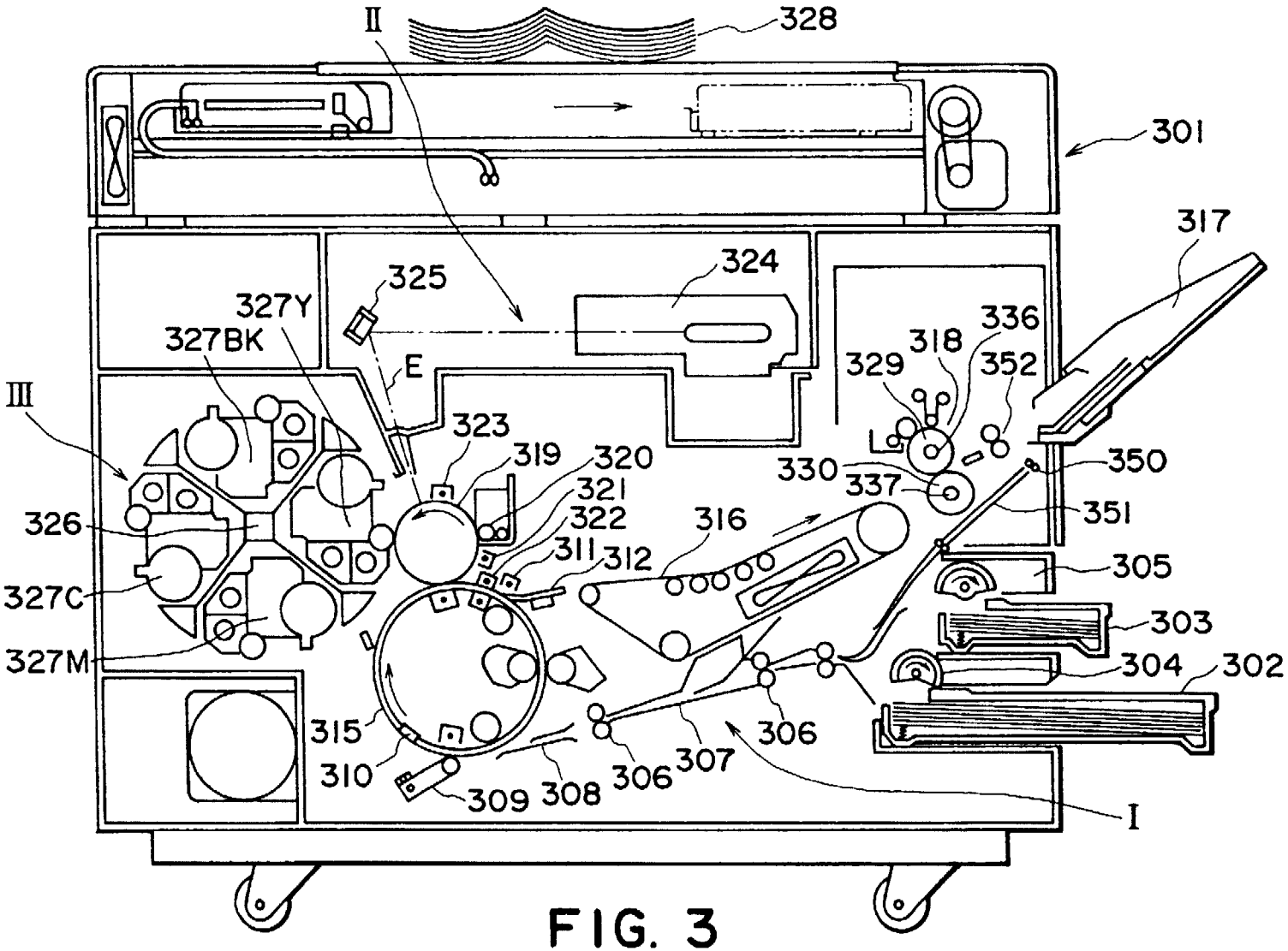
FIG. 3 is a schematic view of a full-color image forming apparatus to which the developing method according to the invention is applicable.

The color electrophotographic apparatus shown in FIG. 3 is roughly divided into a transfer material (recording sheet)-conveying section I including a transfer drum 315 and extending from the right side (the right side of FIG. 3) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly 301, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a glipper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly 301.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 3, the moving peripheral speeds (hereinafter called "process speed") of the respective members, particularly the photosensitive drum 319, may be at least 100 mm/sec. (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the glipper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 3).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by image-wise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the glipper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Alternatively, the respective color toner images can be once transferred onto an intermediate transfer member and then transferred to a transfer material to be fixed thereon.

The fixing speed of the fixing device is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

Now, methods for measuring various properties referred to herein will be described.

[Particle size of carrier]

At least 300 particles (diameter of 0.1 μm or larger) are taken at random from a sample carrier by observation through a scanning electron microscope at a magnification of 100–5000, and an image analyzer (e.g., "Luzex 3" available from Nireco K.K.) is used to measure the horizontal FERE diameter of each particle as a particle size, thereby obtaining a number-basis particle size distribution and a number-average particle size, from which the number-basis proportion of particles having sizes in the range of at most a half of the number-average particle size is calculated.

[Magnetic properties of a magnetic carrier]

Measured by using an oscillating magnetic field-type magnetic property automatic recording apparatus ("BHV-30", available from Riken Denshi K.K.). A magnetic carrier is placed in an external magnetic field of 1 kilo-oersted to measure its magnification. The magnetic carrier powder sample is sufficiently tightly packed in a cylindrical plastic cell so as not to cause movement of carrier particles during the movement. In this state, a magnetic moment is measured and divided by an actual packed sample weight to obtain a magnetization (emu/g). Then, the true density of the carrier particles is measured by a dry-type automatic density meter ("Accupic 1330", available from Simazu Seisakusho K.K.) and the magnetization (emu/g) is multiplied by the true density to obtain a magnetization per volume (emu/cm$^3$).

[Measurement of (electrical) resistivity of carrier]

Figure 2:
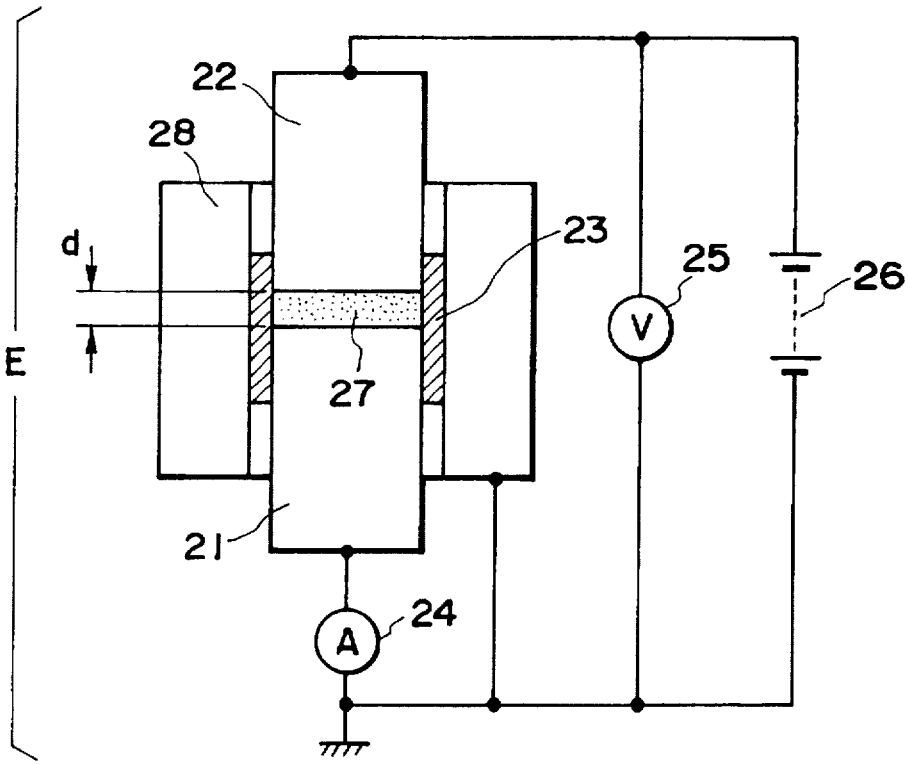
FIG. 2 is an illustration of an apparatus for measuring the (electrical) resistivity of a carrier, a carrier core, and a non-magnetic metal oxide.

The resistivity of a carrier is measured by using an apparatus (cell) E as shown in FIG. 2 equipped with a lower electrode 21, an upper electrode 22, an insulator 23, an ammeter 24, a voltmeter 25, a constant-voltage regulator 26 and a guide ring 28. For measurement, the cell E is charged with ca. 1 g of a sample carrier 27, in contact with which the electrodes 21 and 22 are disposed to apply a voltage therebetween, whereby a current flowing at that time is measured to calculate a resistivity. As a magnetic carrier is in powder form so that care should be taken so as to avoid a change in resistivity due to a change in packing state. The resistivity values described herein are based on measurement under the conditions of the contact area S between the carrier 27 and the electrode 21 or 12=ca. 2.3 cm$^2$, the carrier thickness d=ca. 2 mm, the weight of the upper electrode 22=180 g, and the applied voltage=100 volts.

[Particle size of metal oxide]

Photographs at a magnification of 5,000–20,000 of a sample metal oxide powder are taken through a transmission electron microscope ("H-800", available from Hitachi Seisakusho K.K.). At least 300 particles (diameter of 0.01 μm or larger) are taken at random in the photographs and subjected to analysis by an image analyzer ("Luzex 3", available from Nireco K.K.) to measure a horizontal FERE diameter of each particle as its particle size. From the measured values for the at least 300 sample particles, a number-average particle size is calculated.

[Resistivity of metal oxide]

Measured similarly as the above-mentioned resistivity measurement for a carrier.

[Exposure density of metal oxide at carrier surface]

The density of exposure of metal oxide particles at the carrier surface of coated magnetic carrier particles is measured by using enlarged photographs at a magnification of 5,000–10,000 taken through a scanning electron microscope ("S-800", available from Hitachi Seisakusho K.K.) at an accelerating voltage of 1 kV. Each coated magnetic carrier particle is observed with respect to its front hemisphere to count the number of exposed metal oxide particles (i.e., the number of metal oxide particles protruding out of the surface) per unit area. Protrusions having a diameter of 0.01 μm or larger may be counted. This operation is repeated with respect to at least 300 coated metal oxide particles to obtain an average value of the number of exposed metal oxide particles per unit area.

[Trifunctional Si/difunctional Si ratio in silicone resin]

Calculated based on numbers of substituent groups and Si elements based on elementary analysis and NMR spectroscopy.

[Particle size of toner]

Into 100–150 ml of an electrolyte solution (1%-NaCl aqueous solution), 0.1–5 ml of a surfactant (alkylbenzenesulfonic acid salt) is added, and 2–20 mg of a sample toner is added. The sample suspended in the electrolyte liquid is subjected to a dispersion treatment for 1–3 min. and then to a particle size distribution measurement by a laser scanning particle size distribution analyzer ("CIS- 100", available from GALAI Co.). Particle in the size range of 0.5 μm–60 μm are measured to obtain a number-average particle size (D1) and a weight-average particle size (D4) by computer processing. From the number-basis distribution, the percentage by number of particles having sizes of at most a half of the number-average particle size is calculated. Similarly, from the volume-basis distribution, the percentage by volume of particles having sizes of at least two times the weight-average particle size is calculated.

[Residual monomer content in toner]

0.2 g of a sample toner is dissolved in 4 ml of THF and the solution is subjected to gas chromatography under the following conditions to measure the monomer content according to the internal standard method.

Apparatus: Shimazu GC-15A

Carrier: $N_2$, 2 kg/cm$^2$, 50 ml/min., split ratio=1:60, linear velocity=30 mm/sec.

Column: ULBON HR-1, 50 mm×0.25 mm

Temperature rise: held at 50° C. for 5 min., raised to 100° C. at 5° C./min., raised to 200° C. at 10° C./min. and held at 200° C.

Sample volume: 2 μl

Standard sample: toluene

[Triboelectric charge]

5 wt. parts of a toner and 95 wt. parts of a magnetic carrier are and the mixture is subjected to mixing for 60 sec. by a Turbula mixer. The resultant powder mixture (developer) is placed in a metal container equipped with a 635-mesh electroconductive screen at the bottom, and the toner in the developer is selectively removed by sucking at a suction pressure of 250 mmHg through the screen by operating an aspirator. The triboelectric charge Q of the toner is calculated from a weight difference before and after the suction and a voltage resulted in a capacitor connected to the container based on the following equation:

$$Q(\mu C/g)=(C\times V)/(W_1-W_2),$$

wherein $W_1$ denotes the weight before the suction, $W_2$ denotes the weight after the suction, C denotes the capacitance of the capacitor, and V denotes the potential reading at the capacitor.

Hereinbelow, the present invention will be described more specifically based on Examples.

Production Example A (polymerization toner)

Into 710 wt. parts of deionized water, 450 wt. parts of 0.1M-$Na_3PO_4$ aqueous solution was charged and warmed at 60° C. under stirring at 12,000 rpm by a high-speed stirrer ("TK-Homomixer", available from Tokushu Kika Kogyo K.K.). Then, 68 wt. parts of 1.0M-$CaCl_2$ aqueous solution was gradually added to the system to obtain an aqueous medium containing $Ca_3(PO_4)_2$. Separately, a monomer composition was prepared in the following manner.

| (Monomer) | |
|---|---|
| Styrene | 165 wt. parts |
| n-Butyl acrylate | 35 wt. parts |
| (Colorant) | 15 wt. parts |
| C.I. Pigment Blue 15:3 | |
| (Charge control agent) | 3 wt. parts |
| D-t-butylsalicylic acid metal compound | |
| (Polar resin) | 10 wt. parts |
| Saturated polyester (acid value (AV) = 14, peak molecular weight (Mp) = 8000) | |
| (Low-softening point substance (release agent)) | 50 wt. parts |
| Ester wax (melting point Temp. = 70°C.) | |

The above ingredients were warmed at 60° C. and subjected to uniform dissolution and dispersion under stirring at 12,000 rpm (by TK-Homomixer), and then 10 wt. parts of 2,2'-azobis(2,4-dimethylvaleronitrile) (polymerization initiator) was dissolved therein to form a polymerizable monomer composition.

Into the above-prepared aqueous medium, the polymerizable monomer composition was charged, and the system was stirred at 11,000 rpm (by TK-Homomixer) for 10 min. at 60° C. in an $N_2$-environment to disperse the composition into a particulate form. (This step is hereinafter referred to a "particulation".) Then, the system was stirred by a paddle stirrer and heated to 80° C. to effect polymerization for 10 hours. After the polymerization, the system was subjected to distilling-off of the residual monomer under a reduced pressure, cooling, addition of hydrochloric acid to dissolve the calcium phosphate, filtration, washing with water and drying to obtain cyan toner particles A.

The resultant cyan toner particles A exhibited a weight-average particle size (D4) of ca. 5.6 μm, a number average particle size (D1) of 4.5 μm, a percentage (cumulative) by number of particles having sizes of at most a half of D1 (hereinafter denoted by "≦1/2D1%") of 6.3% N (% N represents a percent by number), and a percentage (cumulative) by volume of particles having sizes of at least two times D4 (hereinafter denoted by "≧2D4%") of 0% V (% V represents a percent by volume). The cyan toner particles A had a core-shell structure enclosing the ester wax.

To 100 wt. parts of the cyan toner particles A, 2.0 wt. % of hydrophobic silica fine powder having a specific surface area according to the BET method ($S_{BET}$) of 200 m$^2$/g was externally added to prepare Cyan Toner A (suspension polymerization toner). Cyan Toner A exhibited a shape factor SF-1 of 101, a residual monomer content (Mres) of 480 ppm, and a percentage coverage (CV %) with external additive (hydrophobic silica) of 65%.

Production Example B (polymerization toner)

Cyan toner particles B were prepared in the same manner as in Production Example A except that the stirring speed in the particulation step was reduced to 9500 rpm (by TK-Homomixer).

The Cyan toner particles B exhibited D4=ca. 7.9 μm, D1=6.2 μm, ≦1/2D1%=9.0% N, and ≧2D4%=0.1% V.

To 100 wt. parts of the cyan toner particles B, 1.0 wt. % of hydrophobic silica ($S_{BET}$=200 m$^2$/g) was externally added to obtain Cyan Toner B. Cyan Toner B exhibited SF-1=104, Mres.=770 ppm, and CV %=53%.

| (Monomer) | |
|---|---|
| Styrene | 165 wt. parts |
| n-Butyl acrylate | 35 wt. parts |
| (Colorant) | 15 wt. parts |
| C.I. Pigment Blue 15:3 | |
| (Charge control agent) | 3 wt. parts |
| Di-t-butylsalicylic acid metal compound | |
| (Polar resin) | 10 wt. parts |
| Saturated polyester (AV = 14, Mp = 8000) | |

The above ingredients were warmed at 60° C. and subjected to uniform dissolution and dispersion under stirring at 12,000 rpm (by TK-Homomixer), and 10 wt. parts of 2,2'-azobis(2,4-dimethylvaleronitrile) was dissolved to form a polymerizable composition.

Cyan toner particles C were prepared by using the above-formed polymerizable monomer composition otherwise in the same manner as in Production Example including the reduced pressure condition for removing the residual monomer.

The thus-prepared cyan toner particles C exhibited D4=ca. 5.9 μm, D1=4.7 μm, ≦1/2D1%=5.3% N, and ≧2D4%=0% V.

To 100 wt. parts of the cyan toner particles C, 2.0 wt. % of hydrophobized titanium oxide fine powder ($S_{BET}$=200 $m^2/g$) was externally added to obtain Cyan Toner C (suspension polymerization toner). Cyan Toner C exhibited SF-1=102, Mres=590 ppm and CV %=70%.

Production Example D (polymerization toner)

| (Monomer) | |
|---|---|
| Styrene | 165 wt. parts |
| n-Butyl acrylate | 35 wt. parts |
| (Colorant) | 15 wt. parts |
| C.I. Pigment Blue 15:3 | |
| (Charge control agent) | 3 wt. parts |
| Di-t-butylsalicylic acid metal compound | |
| (Polar resin) | 10 wt. parts |
| Saturated polyester (AV = 14, Mp = 8000) | |

The above ingredients were warmed at 60° C. and subjected to uniform dissolution and dispersion under stirring at 12,000 rpm (by TK-Homomixer), and 10 wt. parts of 2,2'-azobis(2,4-dimethylvaleronitrile) was dissolved to form a polymerizable composition.

Into an aqueous medium identical to the one prepared in Production Example A, the above-prepared polymerizable monomer composition was charged, and the system was stirred at 11,000 rpm (by TK-Homomixer) for 10 min. at 60° C. in an $N_2$-environment to effect particulation. Then, the system was stirred by a paddle stirrer under heating at 60° C. to effect polymerization for 6 hours. After the polymerization, the system was subjected to cooling, addition of hydrochloric acid to dissolve the calcium phosphate, filtration, washing with water and drying to obtain cyan toner particles D.

The thus-prepared cyan toner particles D exhibited D4=ca. 5.2 μm, D1=4.2 μm, ≦1/2D1%=6.7% N, and ≧2D4%=0% V.

To 100 wt. parts of the cyan toner particles D, 2.0 wt. % of hydrophobized titanium oxide fine powder ($S_{BET}$=200 $m^2/g$) was externally added to obtain Cyan Toner D (suspension polymerization toner). Cyan Toner D exhibited SF-1=101, Mres=2700 ppm and CV %=50%.

Production Example E (pulverization toner)

Into a four-necked flask, 180 wt. parts of nitrogen-aerated water and 20 wt. parts of aqueous solution containing 0.2 wt. part of polyvinyl alcohol were charged, followed further by addition of 77 wt. parts of styrene, 22 wt. parts of n-butyl acrylate, 1.4 wt. parts of benzolyl peroxide and 0.2 wt. part of divinylbenzene, followed by stirring to obtain a suspension liquid. Thereafter, the interior of the flask was replaced by nitrogen, and the system was heated to 80° C. to effect 10 hours of polymerization at that temperature, thereby producing a styrene-n-butyl acrylate copolymer.

The copolymer was washed with water and dried at 65° C. under a reduced pressure to recover the styrene-n-butyl acrylate copolymer (Mw=7×$10^5$, Mw/Mn=40). To 80 wt. parts of the copolymer, 2 wt. parts of metal-containing azo dye, 4 wt. parts of carbon black and 3 wt. parts of low-molecular weight polypropylene were added and blended within a fixed vessel-type dry blender. The blend was then melt kneaded through a twin-screw extruder while connecting its vent port to a suction pump for sucking.

The result melt-kneaded product, after cooling for solidification, coarsely crushed by a hammer mill to recover a coarse pulverizate having a size of passing a 1 mm-mesh sieve. The coarse pulverizate was then pulverized by a jet mill utilizing collision of the particles in a whirling stream and then classified by a multi-division classifier utilizing the Coanda effect to obtain black toner particles E.

The thus-prepared black toner particles E exhibited D4=ca. 6.0 μm, D1=4.2 μm, ≦1/2D1%=22.9% N, and ≧2D4%=0.1% V.

To 100 wt. parts of the black toner particles E, 2.0 wt. % of hydrophobized titanium oxide fine powder was externally added to obtain Black Toner E (pulverization toner). Black Toner E exhibited SF-1=149, Mres=900 ppm and CV %=43%.

EXAMPLE 1

| | |
|---|---|
| Phenol (phenyl hydroxide) | 7 wt. parts |
| Formalin solution (containing ca. 40 wt. % of formaldehyde, ca. 10 wt. % of methanol, and remainder of water) | 10.5 wt. parts |
| Magnetite (lipophilic, treated with 0.5 wt. % of γ-aminopropyltrimethoxysilane) (magnetic metal oxide particles, Dav. (average particle size) = 0.25 μm, Rs (resistivity) = 5.1 × $10^5$ ohm · cm) | 53 wt. parts |
| α-$Fe_2O_3$ (lipophilic, treated with 0.5 wt. % of γ-aminopropyltrimethoxysilane) (non-magnetic metal oxide particles, Dav. = 0.60 μm, Rs = 7.8 × $10^5$ ohm · cm) | 35 wt. parts |

(The lipophilicity-imparting treatment for the magnetic and α-$Fe_2O_3$ (hematite) was performed by adding 0.5 wt. part of γ-aminotrimethoxysilane to 99.5 wt. parts of magnetite or α-$Fe_2O_3$, and the mixture was stirred at 100° C. for 30 min. in a Henschel mixer. Lipophilic metal oxides used in Examples described hereinafter were obtained by an identical lipophilicity-imparting treatment.)

The above materials, 2.5 wt. parts of 28 wt. % ammonia water (basic catalyst) and 20 wt. parts of water were placed in a flask and, under stirring for mixing, heated to 85° C. in 40 min., followed by holding at that temperature for 3 hours of curing reaction between the phenol and the formaldehyde. Then, the content was cooled to 30° C., and 100 parts of water was added thereto, followed by removal of the supernatant and washing with water and drying in air of the precipitate. The dried precipitate was further dried at 70° C. at a reduced pressure of at most 5 mmHg, thereby to obtain spherical particles containing the magnetite and the hematite in a phenolic resin binder. The particles were caused to pass through a 60-mesh sieve to remove the coarse particle fraction, thereby recovering magnetic carrier core particles, which exhibited D1=28 μm and Rs=8.0×$10^{10}$ ohm.cm.

100 wt. parts of the magnetic carrier core particles, 0.5 wt. part of phenol, 0.75 wt. part of formalin solution, 0.2 wt. % of 28 wt. %-ammonia water and 50 wt. parts of water were placed in a flask, heated under stirring to 85° C. in 40 min. and held at the temperature for 3 hours for reaction. After cooling to 30° C., 50 wt. parts of water was added and the supernatant was removed. The resultant supernatant was removed. The resultant precipitate was washed with water, dried in air and dried at 180° C. at a reduced pressure of at most 5 mmHg to obtain phenolic resin-coated carrier core particles, which exhibited D1=28 μm and Rs=$2.1\times10^{12}$ ohm.cm.

100 wt. parts of the thus obtained phenolic resin-coated carrier core particles were coated with a silicone resin composition comprising 0.5 wt. part of straight silicon resin having a difunctional Si/trifunction Si atomic ratio of 0.5:95 and having substituents of all methyl and terminal OH group, 0.025 wt. part of γ-aminopropyltrimethoxysilane and 0.025 wt. part of n-propyltrimethoxysilane in the following manner. First, the above silicone resin composition was dissolved at a concentration of 10 wt. % in toluene to form a carrier coating solution. The coating solution was mixed with the carrier core particles while continuously applying a shearing force to vaporize the solvent, thereby effecting the coating. The resultant coated carrier particles were subjected to 2 hours of curing at 180° C. and, after disintegration, caused to pass a 100 mesh-sieve, thereby selectively removing agglomerated coarse particles to obtain magnetic coated Carrier No. 1, which exhibited D1=28 μm, a particle size distribution containing 0% by number of particles having sizes of at most 14 μm (i.e., ≦1/2D1%=0% N), and also SF-1=104.

As a result of observation through an electron microscope and determination by an image processor, Carrier No. 1 exhibited an average surface exposure density of metal oxide (denoted by MO-exposure rate) of 2.1 (particles)/$\mu m^2$.

Carrier No. 1 further exhibited Rs=$6.0\times10^{13}$ ohm.cm, a magnetization at 1 kilo-oersted ($\sigma_{1000}$) of 130 emu/$cm^3$ and a true specific gravity (SF) of 3.47 g/$cm^3$.

Physical properties of Carrier No. 1 (magnetic coated carrier) are summarized in Table 1 together with those of other Carriers described hereinafter.

When blended with Carrier No. 1, Cyan Toner A showed a triboelectric charge of −29.9 μC/g.

91.5 wt. parts of Carrier No. 1 and 8.5 wt. parts of Cyan Toner A were blended with each other to form a two-component type developer. The developer was charged in a full-color laser copier ("CLC-500") in a remodeled form so as to have developing devices each as shown in FIG. 1. Referring to FIG. 1, each developing device was designed to have a spacing A of 600 μm between a developer carrying member (developing sleeve) 1 and a developer-regulating member (magnetic blade) 2, and a gap B of 500 μm between the developing sleeve 1 and an electrostatic latent image-bearing member (photosensitive drum) 3 having a polytetrafluoroethylene-dispersed surface protective layer. A developing nip C at that time was 5.5 mm. The developing sleeve 1 and the in photosensitive drum 3 were driven at a peripheral speed ratio of 1.75:1. A developing pole S1 of the developing sleeve was designed to provide a magnetic field of 997 oersted, and the developing conditions included an alternating electric field of a rectangular waveform having a peak-to-peak voltage of 2000 volts and a frequency of 2200 Hz, a developing bias of −470 volts, a toner developing contrast (Vcont) of 350 volts, a fog removal voltage (Vback) of 80 volts, and a primary charge voltage on the photosensitive drum of −550 volts. The developer sleeve was composed of a 25 mm-dia. cylindrical sleeve of SUS (mfd. by Hitachi Kinzoku K.K.) of which the surface had been sand-blasted (by means of "Pneumablaster", available from Fuji Seisakusho K.K.) to have Ra=2.1 μm and Sm=29.7 μm (Ra/Sm=0.07). By using the developing device including the blasted developing sleeve under the above-mentioned developing conditions, a digital latent image (spot diameter=64 μm) on the photosensitive drum 3 was developed by a reversal development mode. The developing device included a hot fixing roller surfaced with a fluorine-containing resin, which was used without application of a release oil. (Separately, for a fixing test, the copying apparatus was remodeled so as to allow taking out of sheets carrying unfixed images out of the copying apparatus and allow a fixing test for evaluating the toner fixability by using an external fixing device capable of using arbitrary fixing temperatures.)

As a result, the resultant images showed a high solid part image density (cyan toner) of 1.60, were free from roughening of dots, and showed no image disorder or fog at the image or non-image portion due to carrier attachment.

Separately, a toner transfer rate was determined based on toner amounts on the photosensitive drum before and after the transfer (Toner amount (1) and Toner amount (2)) (mg/$cm^2$) according to the following equation:

$$\text{Transfer rate (\%)}=[1-(\text{Toner amount (2)}/\text{Toner amount (1)})]\times100.$$

The transfer rate was 99.1%.

Further, as a result of the fixation test using the external fixing device, the developer showed a lowest fixable temperature (giving an image density lowering in solid fixed image of at most 10% by one reciprocal rubbing with a lens-cleaning paper) of 130° C.

Further, a continuous image formation on 50,000 sheets was performed. Thereafter, an imaging test was performed similarly as in the initial stage. The solid image portion provided an image density of 1.59 similar to that in the initial stage, and the halftone portion showed a good reproducibility. Further, no carrier attachment or fog was observed. When the carrier particles in the developer after the continuous image formation was observed through a SEM (scanning electron microscope), the peeling on the coating resin of the carrier or spent toner deposition was not observed thus exhibiting a good surface state similarly as that of the initial carrier particle surface. No liberation of metal oxide was observed either. Further, the transfer rate after the continuous image formation was 97.8%, and was sufficient to be adapted to a cleaner-less process. Toner filming was not observed either on the photosensitive member after the continuous image formation.

The results are shown in Table 2 together with those of other Examples described hereinafter.

EXAMPLE 2

Carrier No. 2 (magnetic coated carrier) was prepared in the same manner as in Example 1 except for replacing the coating silicone resin composition with one comprising 0.5 wt. part of straight silicon resin having a difunctional Si/trifunction Si ratio of 45:55 and having substituents of all methyl and 0.025 wt. part of γ-aminopropyltrimethoxysilane.

The thus-obtained Carrier No. 2 exhibited D1=28 μm, ≦1/2D1%=0% N, and SF-1=105.

Carrier No. 2 further exhibited MO-exposure rate=2.8/$\mu m^2$, Rs=$3.3\times10^{13}$ ohm.cm, $\sigma_{1000}$=129 emu/$cm^3$, SG=3.47 g/$cm^3$, and provided a triboelectric charge of −28.0 μC/g to Cyan Toner A.

91.5 wt. parts of Carrier No. 2 was blended with 8.5 wt. parts of Cyan Toner A to prepare a two-component type developer, and the developer was charged in the re-modeled laser color copier ("CLC-500") and subjected to image forming tests in the same manner as in Example 1. As a result, the developer provided good images showing a high solid image density of 1.60, excellent initial image qualities including particularly excellent dot reproducibility and high resolution. Further, no fog or carrier attachment was observed.

Further, even after the continuous image formation on 50,000 sheets, images similar to those at the initial stage were obtained, including a solid image density of 1.64. Similarly as in Example 1, no carrier attachment was observed. As a result of observation of the carrier particle surface after the continuous image formation, the surface state was good similarly as that in the initial stage. The transfer rates before and after the continuous image formation were 98.9% and 97.1%, respectively. Further, toner filming was not observed on the photosensitive member after the continuous image formation.

EXAMPLE 3

Carrier No. 3 (magnetic coated carrier) was prepared in the same manner as in Example 1 except for replacing the coating silicone resin composition with one comprising 0.5 wt. part of straight silicon resin having a difunctional Si/trifunction Si ratio of 2.5:75 and having substituents of all methyl, 0.025 wt. part of γ-aminopropyltrimethoxysilane, and 0.025 wt. part of n-propyltrimethoxysilane.

The thus-obtained Carrier No. 3 exhibited D1=29 μm, ≦1/2D1%=0% N, and SF-1=103.

Carrier No. 3 further exhibited MO-exposure rate=2.2/μm$^2$, Rs=5.4×10$^{13}$ ohm.cm, $\sigma_{1000}$=131 emu/cm$^3$, SG=3.47 g/cm$^3$, and provided a triboelectric charge of −31.0 μC/g to Cyan Toner A.

91.5 wt. parts of Carrier No. 3 was blended with 8.5 wt. parts of Cyan Toner A to prepare a two-component type developer, and the developer was charged in the re-modeled laser color copier ("CLC-500") and subjected to image forming tests in the same manner as in Example 1. As a result, the developer provided good images showing a high solid image density of 1.58, excellent initial image qualities including particularly excellent dot reproducibility and high resolution. Further, no fog or carrier attachment was observed. Further, even after the continuous image formation on 50,000 sheets, images similar to those at the initial stage were obtained, including a solid image density of 1.55. Similarly as in Example 1, no carrier attachment was observed. As a result of observation of the carrier particle surface after the continuous image formation, the surface state was good similarly as that in the initial stage. The transfer rates before and after the continuous image formation were 99.2% and 98.0%, respectively. Further, toner filming was not observed on the photosensitive member after the continuous image formation.

EXAMPLE 4

| | |
|---|---|
| Phenol | 7.5 wt. parts |
| Formalin solution (Same as in Example 1) | 11.25 wt. parts |
| Magnetite (lipophilic, Same as in Example 1) | 53 wt. parts |
| α-$Fe_2O_3$ (lipophilic) (Dav. = 0.42 μm, Rs = 8.0 × 10$^9$ ohm · cm) | 35 wt. parts |

The above materials, 3.0 wt. parts of 28 wt. % ammonia water (basic catalyst) and 20 wt. parts of water were placed in a flask and, under stirring for mixing, heated to 85° C. in 40 min., followed by holding at that temperature for 3 hours of curing reaction. Then, the content was cooled to 30° C., and 100 parts of water was added thereto, followed by removal of the supernatant and washing with water and drying in air of the precipitate. The dried precipitate was further dried at 180° C. at a reduced pressure of at most 5 mmHg, thereby to obtain spherical particles containing the magnetite and the hematite in a phenolic resin binder. The particles were subjected to sieving for removing coarse particles in the same manner as in Example 1 to obtain magnetic carrier core particles, which exhibited D1=33 μm and Rs=4.4×10$^{10}$ ohm.cm.

The magnetic carrier core particles were coated with the same silicone resin composition in the same manner as in Example 1 to prepare Carrier No. 4.

The thus-obtained Carrier No. 4 exhibited D1=33 μm, ≦1/2D1%=0% N, and SF-1=101.

Carrier No. 4 further exhibited MO-exposure rate=15.3 μm$^2$, Rs=5.3×10$^{12}$ ohm.cm, $\sigma_{1000}$=135 emu/cm$^3$, SG=3.49 g/cm$^3$, and provided a triboelectric charge of −30.0 μC/g to Cyan Toner A.

91.5 wt. parts of Carrier No. 4 was blended with 8.5 wt. parts of Cyan Toner A to prepare a two-component type developer, and the developer was charged in the re-modeled laser color copier ("CLC-500") and subjected to image forming tests in the same manner as in Example 1. As a result, the developer provided good images showing a high solid image density of 1.59, excellent initial image qualities including particularly excellent dot reproducibility and high resolution. The transfer rate was 98.5%. Further, no fog or carrier attachment was observed. Further, even after the continuous image formation on 50,000 sheets, images similar to those at the initial stage were obtained, including a solid image density of 1.58. Similarly as in Example 1, no carrier attachment was observed. As a result of observation of the carrier particle surface after the continuous image formation, the surface state was good similarly as that in the initial stage. The transfer rate after the continuous image formation was 98.0%. Further, toner filming was not observed on the photosensitive member after the continuous image formation.

EXAMPLE 5

| | |
|---|---|
| Phenol | 6 wt. parts |
| Formalin solution (Same as in Example 1) | 10 wt. parts |
| Magnetite (lipophilic, Same as in Example 1) | 45 wt. parts |
| $Al_2O_3$ (lipophilic) (Dav. = 0.67 μm, Rs = 9.0 × 10$^{13}$ ohm · cm) | 35 wt. parts |

The above materials, 2.5 wt. parts of 28 wt. % ammonia water (basic catalyst) and 15 wt. parts of water were placed in a flask and, under stirring for mixing, heated to 85° C. in 40 min., followed by holding at that temperature for 3 hours of curing reaction. Then, the content was cooled to 30° C., and 100 parts of water was added thereto, followed by removal of the supernatant and washing with water and drying in air of the precipitate. The dried precipitate was further dried at 150° C. at a reduced pressure of at most 5 mmHg, thereby to obtain spherical particles containing the magnetite and the aluminum oxide in a phenolic resin binder. The particles were subjected to sieving for removing coarse particles in the same manner as in Example 1 to obtain magnetic carrier core particles, which exhibited D1=48 μm and Rs=$9.5\times10^{11}$ ohm.cm.

The magnetic carrier core particles were coated in the same manner as in Example 1 except for replacing the coating silicone resin composition with one comprising 0.5 wt. part of straight silicon resin having a difunctional Si/trifunction Si ratio of 25:75 and having substituents of phenyl and methyl, 0.025 wt. part of γ-aminopropyltrimethoxysilane and 0.025 wt. part of dibutyltin acetate to obtain Carrier No. 5.

The thus-obtained Carrier No. 5 exhibited D1=48 μm, ≦1/2D1%=0% N, and SF-1=103.

Carrier No. 5 further exhibited MO-exposure rate=4.3/$\mu m^2$, Rs=$7.5\times10^{13}$ ohm.cm, $\sigma_{1000}$=113 emu/$cm^3$, SG=3.65 g/$cm^3$, and provided a triboelectric charge of −23.1 μC/g to Cyan Toner B.

93.5 wt. parts of Carrier No. 5 was blended with 6.5 wt. parts of Cyan Toner B to prepare a two-component type developer, and the developer was charged in the re-modeled laser color copier ("CLC-500") and subjected to image forming tests in the same manner as in Example 1 except that the developing sleeve (of SUS) was provided with surface unevenness factors Ra=3.8 μm, Sm=18.8 μm and Ra/Sm=0.202. As a result, the developer provided good images showing a high solid image density of 1.66, excellent initial image qualities including particularly excellent dot reproducibility and high resolution. Further, the transfer rate was 99.5%. Further, even after the continuous image formation on 50,000 sheets, images similar to those at the initial stage were obtained, including a solid image density of 1.63 and good dot and halftone reproducibilities. As a result of observation through SEM of the carrier particle surface after the continuous image formation, the surface state was almost free from spent toner accumulation and peeling of the coating material good. The transfer rate after the continuous image formation was 98.7%. Further, toner filming was not observed on the photosensitive member after the continuous image formation.

EXAMPLE 6

100 wt. parts of the core particles prepared in Example 1, 0.5 wt. part of phenol, 0.75 wt. parts of formalin solution (same as in Example 1), 1 wt. part of lipophilic α-$Fe_2O_3$ (same as in Example 1), 0.2 wt. part of 28 wt. %-ammonia water and 50 wt. parts of water, were placed in a flask, heated under stirring to 85° C. in 40 min. and held at that temperature for 3 hours for curing reaction. Then, the content was cooled to 30° C., and 50 wt. parts of water was added thereto, followed by removal of the supernatant. The precipitate was washed with water, dried in air and further dried at 170° C. at a reduced pressure of at most 5 mmHg to obtain surface phenolic resin-coated carrier core particles.

The coated carrier core particles were further coated with the same silicone resin composition in the same manner as in Example 1 to obtain Carrier No. 6. The thus-obtained Carrier No. 6 exhibited D1=29 μm, ≦1/2D1%=0% N, and SF-1=104.

Carrier No. 6 further exhibited MO-exposure rate=4.0/$\mu m^2$, Rs=$2.5\times10^{13}$ ohm.cm, $\sigma_{1000}$=124 emu/$cm^3$, SG=3.45 g/$cm^3$, and provided a triboelectric charge of −28.1 μC/g to Cyan Toner A.

91.5 wt. parts of Carrier No. 6 was blended with 8.5 wt. parts of Cyan Toner A to prepare a two-component type developer, and the developer was subjected to image forming tests in the same manner as in Example 1. As a result, the developer provided good images showing a high solid image density of 1.57, excellent initial image qualities including particularly excellent dot reproducibility. The transfer rate was 98.0%. Further, even after the continuous image formation on 50,000 sheets, images similar to those at the initial stage were obtained, including a solid image density of 1.60. No carrier attachment was observed. As a result of observation of the carrier particle surface after the continuous image formation, the surface state was good. The transfer rate after the continuous image formation was free from liberation of metal oxide, peeling of the coating and spent toner accumulation 97.0%. Further, toner filming was not observed on the photosensitive member.

EXAMPLE 7

| | |
|---|---|
| Melamine | 25 wt. parts |
| Formalin solution (Same as in Example 1) | 37.5 wt. parts |
| Magnetite (Dav. = 0.25 μm, (Rs = $5.1\times10^5$ ohm · cm) (lipophilic, treated with 0.5 wt. % of isopropyltri(N-aminoethylamino-ethyl)titanate) | 60 wt. parts |

By using the above materials, otherwise in a similar manner as in Example 5, carrier core particles containing magnetite dispersed in melamine resin were prepared. The carrier core particles exhibited D1=55 μm and Rs=$6.7\times10^{12}$ ohm.cm.

The carrier core particles were coated in the same manner as in Example 1 except for replacing the coating silicone resin composition with one comprising 0.5 wt. part of straight silicon resin having a difunctional Si/trifunction Si ratio of 25:75 and having substituents of phenyl and methyl and 0.025 wt. part of isoproyltri(N-aminoethylaminoethyl) titanate, to obtain Carrier No. 7.

The thus-obtained Carrier No. 7 exhibited D1=55 μm, ≦1/2D1%=0.5% N, and SF-1=102.

Carrier No. 7 further exhibited MO-exposure rate=1.1/$\mu m^2$, Rs=$1.3\times10^{14}$ ohm.cm, $\sigma_{1000}$=84 emu/$cm^3$, SG=1.99 g/$cm^3$, and provided a triboelectric charge of −22.0 μC/g to Cyan Toner B.

93.5 wt. parts of Carrier No. 7 was blended with 6.5 wt. parts of Cyan Toner B to prepare a two-component type developer, and the developer was charged in the re-modeled laser color copier ("CLC-500") and subjected to image forming tests in the same manner as in Example 1. As a result, the developer provided good images showing a high solid image density of 1.63, excellent initial image qualities including a halftone reproducibility. Further, no fog or carrier attachment was observed. The transfer rate was 98.4%. Further, even after the continuous image formation on 50,000 sheets, images similar to those at the initial stage were obtained, including a solid image density of 1.68. No fog or carrier attachment was observed. As a result of observation of the carrier particle surface after the continuous image formation, no liberation of metal oxide was observed and the surface state was good similarly as that in the initial stage. The transfer rate after the continuous image formation was 97.7%. Further, toner filming was not observed on the photosensitive member.

EXAMPLE 8

Magnetic Ca—Mg—Fe-ferrite particles (D1=49 μm) were heated in air at 800° C. for 2 hours to provide magnetic carrier core particles, which exhibited $6.0\times10^{10}$ ohm.cm.

The core particles were coated in the same manner as in Example 7 except for changing the amount of the coating silicone resin composition to 0.8 wt. part.

The thus-obtained Carrier No. 8 exhibited D1= 49 μm, ≦1/2D1%=13.8% N, and SF-1=114. Carrier No. 8 further exhibited, Rs=$1.5\times10^{13}$ ohm.cm, $\sigma_{1000}$=206 emu/cm$^3$, SG=4.96 g/cm$^3$, and provided a triboelectric charge of −20.4 μC/g to Cyan Toner B.

95 wt. parts of Carrier No. 8 was blended with 5 wt. parts of Cyan Toner B to prepare a two-component type developer, and the developer was charged in the re-modeled laser color copier ("CLC-500") and subjected to image forming tests in the same manner as in Example 1 except that the spacing A was changed to 700 μm. As a result, the developer provided generally good images showing a solid image density of 1.70, a transfer rate of 96.2% and good initial image qualities free from carrier attachment or fog.

After the continuous image formation on 30,000 sheets, surface was observed, whereby some peeling of the coating material was observed at projection of the core. The image density was 1.75, and some carrier attachment was recognized but not in a serious degree. The transfer rate was 93.7%.

EXAMPLE 9

| | |
|---|---|
| Styrene/butyl acrylate (90/10) copolymer | 30 wt. parts |
| Magnetite (Dav. = 0.24 μm, Rs = $5.1\times10^5$ ohm · cm) | 60 wt. parts |
| Ca—Mg—Fe-ferrite (Dav. = 0.97 μm, Rs = $2.2\times10^8$ ohm · cm) | 10 wt parts |

The above materials were sufficiently preliminarily blended in a Henschel mixer and then melt-kneaded twice on a three-roll mill. After cooling, the kneaded product was coarsely crushed by a hammer mill to a particle size of ca. 2 mm an then pulverized to an average particle size of ca. 36 μm by air jet pulverizer. The pulverizate was introduced into a multi-division classifier (Elbow Jet classifier) to remove fine and coarse powder fractions and recover a medium powder fraction, which was then introduced into Mechanomill (trade name, available from Okada Seiko K.K.) to be mechanically sphered to obtain magnetic material-dispersed resin carrier core particles. The carrier core particles showed D1=37 μm and Rs=$8.6\times10^{12}$ ohm.cm. The core particles were introduced into a spray-type fluidized bed coating apparatus and coated with a coating liquid at a concentration of 5% to provide a coating comprising 0.8 wt. part of the silicone resin and 0.04 wt. part of coupling agent used in Example 1 and 0.03 wt. part of dibutyltin acetate (curing agent), followed by drying therein at 60° C. for 5 hours.

The thus-obtained Carrier No. 7 exhibited D1=37 μm, ≦1/2D1%=12.3% N, SF-1=127, Rs=$9.5\times10^{13}$ ohm.cm, $\sigma_{1000}$=107 emu/cm$^3$ and SG=2.32 g/cm$^3$, and provided a triboelectric charge of −27.7 μC/g to Cyan Toner A.

93 wt. parts of Carrier No. 9 and 7 wt. parts of Cyan Toner A were blended to prepare a developer, which was then subjected to image formation tests in the same manner as in Example 1. As a result, in the initial stage, images having an image density of 1.56 and excellent dot reproducibility were obtained. The transfer rate was 97.0%. Images formed after a continuous image formation on 50,000 sheets were substantially identical to those obtained in the initial stage including an image density of 1.52. Even after the continuous image formation, no carrier attachment was observed. The carrier particle surface showed no liberation of metal oxide, peeling of the coating material or spent toner accumulation. No filming was observed on the photosensitive drum. The transfer efficiency was 93.4%.

EXAMPLE 10

A developer was prepared in the same manner as in Example 1 except for using Cyan Toner C instead of Cyan Toner A, and subjected to an image formation test in the same manner as in Example 1. The toner exhibited a triboelectric charge of −30.2 μC/g. The fixing roller in the copying apparatus was changed to a silicone rubber roller, and silicone oil was applied to the roller. The resultant images showed a high solid image density of 1.66, no roughening of dots and good halftone reproducibility. Further, no image disorder due to carrier attachment was observed at image and non-image portions, and no fog was observed either. The transfer rate was 99.2%. The lowest fixable temperature was 140° C. as a result of fixation test using an external fixing device.

Continuous image formation was performed on 50,000 sheets. Images formed after 50,000 sheets exhibited a solid image density of 1.65 which was similarly high as in the initial stage, and good halftone reproducibility. No cleaning failure occurred. No fog or carrier attachment was observed either. The transfer rate was 98.8%. As a result of observation through a scanning electron microscope, the carrier particle surface after the continuous image formation exhibited no peeling of the coating material but exhibited a surface state similar to that in the initial stage.

No filming was observed on the photosensitive member after the continuous image formation.

Comparative Example 1

Cu—Zn—Fe-ferrite particles (D1=45 μm) were used as core particles, which exhibited Rs=$4.0\times10^8$ ohm.cm.

The core particles were coated with the same coating resin composition in the same manner as in Example 5 to Carrier No. 10 (coated magnetic carrier), which exhibited D1=45 μm, ≦1/2D1%=18.8% N, SF-1=118, Rs=$4.4\times10^{10}$ ohm.cm, $\sigma_{1000}$=305 emu/cm$^3$ and SG=5.02 g/cm$^3$, and provided a triboelectric charge of −22.9 μC/g to Cyan Toner B.

Similarly as in Example 5, 93.5 wt. parts of Carrier No. 10 was blended with 6.5 wt. parts of Cyan Toner B to prepare a developer which was then charged in the re-modeled copying machine and subjected to an image forming test in the same manner as in Example 5. As a result, the resultant images showed a high solid image density of 1.63 but showed inferior roughening of dots and halftone reproducibility. The transfer rate was 93.5%. As a result of a continuous image formation test in the same manner as in Example 5, images obtained after 10,000 sheets showed a high image density of 1.73 but provided even rougher halftone images and caused fog along with further progress of continuous image formation. The transfer rate after 10,000 sheets was 83.1%. After the continuous image formation, toner filming was observed on the photosensitive member.

As a result of observation of carrier particles after 10,000 sheets of the continuous image formation test, spent toner deposition and peeling of the coating material were observed. However, when the toner particles were observed, many particles exhibited external additive particles embedded at the surface thereof.

Comparative Example 2

| | |
|---|---|
| Phenol | 6.4 wt. parts |
| Formation solution (Same as in Example 1) | 9 wt. parts |
| Magnetite (no treatment with coupling agent) (Dav. = 0.25 μm, Rs = $5.1 \times 10^5$ ohm · cm) | 90 wt. parts |

Magnetic carrier core particles were prepared by polymerization of the above materials in the presence of 1 wt. part of polyvinyl alcohol as a dispersion stabilizer otherwise in the same manner as in Example 1, followed by classification. The resultant carrier core particles exhibited D1=30 μm and Rs=$1.2\times10^8$ ohm.cm.

100 wt. parts of the core particles were coated with a composition comprising 0.5 wt. part of silicone resin ("SH804", available from Toray Dow Corning Silicone K.K.) and 0.05 wt. part of methyltriethoxysilane otherwise in the same manner as in Example 1 to obtain Carrier No. 11, which exhibited D1=30 μm, ≦1/2D1%=3.2% N, SF-1=105, Rs=$2.7\times10^{10}$ ohm.cm, $\sigma_{1000}$=232 emu/cm$^3$, SG=3.66 g/cm$^3$ and MO-exposure rate=23.5/μm$^2$, and provided a triboelectric charge of −28.1 μC/g to Cyan Toner A.

91.5 wt. parts of Carrier No. 11 was blended with 8.5 wt. parts of Cyan Toner A to prepare a developer which was then subjected to an image forming test in the same manner as in Example 1. As a result, the resultant images in an ordinary environment showed a high solid image density of 1.56 but showed roughening of dots and halftone reproducibility which were somewhat inferior to those in Example 1. The transfer rate was 95.1%. As a result of a continuous image formation test on 50,000 sheets, images obtained thereafter were similar to those at the initial stage including an image density of 1.60. No spent toner deposition or filming on the photosensitive member was observed. The transfer rate after 5,000 sheets was 92.4%.

Comparative Example 3

| | |
|---|---|
| Styrene/butyl acrylate (90/10) copolymer | 30 wt. parts |
| Magnetite (Dav. = 0.24 μm, RS = $5.1 \times 10^5$ ohm · cm) | 60 wt. parts |
| α-$Fe_2O_3$ (Dav. = 0.60 μm, Rs = $7.8 \times 10^9$ ohm · cm) | 10 wt. parts |

The above materials were sufficiently preliminarily blended in a Henschel mixer and then melt-kneaded twice on a three-roll mill. After cooling, the kneaded product was coarsely crushed by a hammer mill to a particle size of ca. 2 mm an then pulverized to an average particle size of ca. 33 μm by air jet pulverizer. The pulverizate was introduced into a multi-division classifier (Elbow Jet classifier) to remove fine and coarse powder fractions and recover a medium powder fraction, which was then introduced into Mechanomill (trade name, available from Okada Seiko K.K.) to be mechanically sphered to obtain magnetic material-dispersed resin carrier core particles, which were used as Carrier No. 12, as they were without further coating.

The thus-obtained Carrier No. 12 exhibited D1=35 μm, ≦1/2D1%=18.2% N, SF-1=135, Rs=$1.4\times10^{14}$ ohm.cm, $\sigma_{1000}$=98 emu/cm$^3$ and SG=2.30 g/cm$^3$, and provided a triboelectric charge of −25.7 μC/g to Cyan Toner A.

92 wt. parts of Carrier No. 12 was blended with 5 wt. parts of Cyan Toner A to prepare a developer which was then subjected to an image forming test in the same manner as in Example 1. As a result, the resultant images showed a high solid image density of 1.59 and fairly good dot and halftone reproducibilities compared with Example 1 but were accompanied with slight fog. The transfer rate was 95.7%. As a result of a continuous image formation test, images obtained after 5,000 sheets showed a higher image density of 1.75 and provided even worse fog and image qualities. As a result of SEM observation, the carrier particle surface state had been changed to be rough.

Comparative Example 4

A developer (toner concentration=8.5 wt. %) was prepared in the same manner as in Comparative Example 2 except for using Cyan Toner D (polymerization toner), which exhibited a triboelectric charge of −27.3 μC/g when combined with Carrier No. 11.

The developer was subjected to an image forming test in the same manner as in Example 1 except that the fixing roller was changed to a silicone rubber roller and silicone oil was applied to the roller. As a result, the resultant images showed a high solid image density of 1.63, were free from roughening of dots and showed a good halftone reproducibility. Further, no image disorder due to carrier attachment was observed at an image or non-image portion, and no toner fog was observed. The transfer rate was 98.9%. The lowest fixable temperature was 150° C. as a result of the fixation test using an external fixing device.

As a result of continuous image formation on 10,000 sheets, however, the resultant images showed gradually increased image densities including a considerably higher solid image density of 1.77 after 10,000 sheets and also showed a lower halftone reproducibility. Further, from after ca. 500 sheets, image soiling occurred and became gradually intense due to transfer residual toner, and the fog tended to be worse. As a result of SEM observation of the carrier particle surface, spent toner deposition was observed. Further, the photosensitive member surface after 10,000 sheets exhibited the occurrence of toner filming. The transfer rate was lowered to 76%.

Comparative Example 5

A developer (toner concentration=8.5 wt. %) was prepared in the same manner as in Comparative Example 2 except for using Cyan Toner E (pulverization toner), which exhibited a triboelectric charge of −32.6 μC/g.

The developer was subjected to an image forming test in the same manner as in Example 1 except that the fixing roller was changed to a silicone rubber roller and silicone oil was applied to the roller. As a result, the resultant images showed a solid image density of 1.55, and showed a good halftone reproducibility. Further, no image disorder due to carrier attachment was observed at an image or non-image portion, but slight lower fog was observed. The transfer rate was considerably low at 92.0% %. The lowest fixable temperature was 155° C. as a result of the fixation test using an external fixing device.

As a result of continuous image formation on 5,000 sheets, the toner particle size in the developing device gradually increased, which led to a gradually higher image density up to a solid image density of 1.65 after 50,000 sheets. Further, the halftone reproducibility was lowered. The photosensitive member surface after the continuous image formation exhibited toner filming. The transfer rate was lowered to 85%.

Comparative Example 6

A developer (toner concentration=8.5 wt. %) was prepared in the same manner as in Comparative Example 2 except for omitting the external additive contained in Cyan Toner A. The toner used had an average particle size, a particle size distribution, SF-1 and a residual monomer content which were substantially identical to those of Cyan Toner A but exhibited a remarkably inferior flowability.

The developer was subjected to an image forming test in the same manner as in Example 1. As a result, the resultant images showed a solid image density of 1.03 and were accompanied with conspicuous roughening of halftone image. Further some fog was observed. The transfer rate was considerably low at 63.3%.

Comparative Example 7

An image forming test was performed in the same manner as in Example 1 except for using the developer of Comparative Example 1 and a developing sleeve (of SUS) provided with surface roughness factors Rs=5.5 μm, Sm=12.0 μm and Ra/Sm=0.458. As a result, images obtained at the initial stage showed a high solid image density of 1.58 and a sufficient halftone reproducibility. Further, no carrier attachment or no toner fog was observed. The transfer rate was 99.3%.

Next, a continuous image formation test was performed. As a result, from the time of around 2000 sheets, images accompanied with image density irregularities presumably attributable to toner sticking onto the developer-carrying member (obstructing uniform developer coating) gradually occurred. Further, the image density was lowered to 1.07 at the time of 2,000 sheets.

Comparative Example 8

An image forming test was performed in the same manner as in Example 1 except for using the developer of Comparative Example 1 and a developing sleeve (of SUS) provided with surface roughness factors Rs=0.2 μm, Sm=85 μm and Ra/Sm=0.0024. As a result, the developer cannot be sufficiently applied onto the developing sleeve from the initial stage, so that the resultant images showed a considerably low image density of 0.82 and appeared to be noticeably rough as a whole.

TABLE 1

Properties of Carriers

| Ex, & Comp.Ex. | Carrier Nos. | Size D1 (μm) | ≦1/2D1% (% N) | Core resistivity $R_z$(ohm · cm) | Carrier Rs (ohm · cm) | $\sigma_{1000}$ (emu/cm$^3$) | S.G. (g/cm$^3$) | SF-1 |
|---|---|---|---|---|---|---|---|---|
| Ex. 1 | 1 | 28 | 0 | $8.0 \times 10^{10}$ | $6.0 \times 10^{13}$ | 130 | 3.47 | 104 |
| 2 | 2 | 28 | 0 | $8.0 \times 10^{10}$ | $3.3 \times 10^{13}$ | 129 | 3.47 | 105 |
| 3 | 3 | 29 | 0 | $9.5 \times 10^{10}$ | $5.4 \times 10^{13}$ | 131 | 3.47 | 103 |
| 4 | 4 | 33 | 0 | $4.4 \times 10^{10}$ | $5.3 \times 10^{13}$ | 135 | 3.49 | 101 |
| 5 | 5 | 48 | 0 | $9.5 \times 10^{10}$ | $7.5 \times 10^{13}$ | 113 | 3.65 | 103 |
| 6 | 6 | 29 | 0 | $8.0 \times 10^{10}$ | $2.5 \times 10^{13}$ | 124 | 3.45 | 104 |
| 7 | 7 | 55 | 0.5 | $6.7 \times 10^{12}$ | $1.3 \times 10^{13}$ | 84 | 1.99 | 102 |
| 8 | 8 | 49 | 13.8 | $6.0 \times 10^{10}$ | $1.5 \times 10^{13}$ | 203 | 4.96 | 114 |
| 9 | 9 | 37 | 12.3 | $8.6 \times 10^{12}$ | $9.5 \times 10^{13}$ | 107 | 2.32 | 127 |
| 10 | 1 | 28 | 0 | $8.0 \times 10^{10}$ | $6.0 \times 10^{13}$ | 130 | 3.47 | 104 |
| Comp. Ex. 1 | 10 | 45 | 18.8 | $4.0 \times 10^{8}$ | $4.4 \times 10^{10}$ | 305 | 5.02 | 118 |
| 2 | 11 | 30 | 3.2 | $1.2 \times 10^{8}$ | $2.7 \times 10^{10}$ | 232 | 3.66 | 105 |
| 3 | 12 | 35 | 18.2 | $1.4 \times 10^{14}$ | $1.4 \times 10^{14}$ | 98 | 2.3 | 135 |
| 4 | 11 | 30 | 3.2 | $1.2 \times 10^{8}$ | $2.7 \times 10^{10}$ | 232 | 3.66 | 105 |
| 5 | 11 | 30 | 3.2 | $1.2 \times 10^{8}$ | $2.7 \times 10^{10}$ | 232 | 3.66 | 105 |
| 6 | 11 | 30 | 3.2 | $1.2 \times 10^{8}$ | $2.7 \times 10^{10}$ | 232 | 3.66 | 105 |
| 7 | 10 | 45 | 18.8 | $4.0 \times 10^{8}$ | $4.4 \times 10^{10}$ | 305 | 5.02 | 118 |
| 8 | 10 | 45 | 18.8 | $4.0 \times 10^{8}$ | $4.4 \times 10^{10}$ | 305 | 5.02 | 118 |

TABLE 2

Image forming performances

| Ex. or Comp. Ex. | T.C. (23° C./60% RH) (μC/g) | Initial stage I.D. | Initial stage Half-tone | Initial stage CA carrier attach | Initial stage Fog | Initial stage Transfer rate (%) | Images after continuous operation I.D. | Images after continuous operation Half-tone | Images after continuous operation CA | Images after continuous operation Fog | Images after continuous operation Transfer rate (%) | Images after continuous operation Filming | $T_{F1}$ (°C.) |
|---|---|---|---|---|---|---|---|---|---|---|---|---|---|
| Ex. 1 | −29.9 | 1.60 | A | A | A | 99.1 | 1.59 | A | A | A | 97.8 | A | 130 |
| 2 | −28 | 1.60 | A | A | A | 98.9 | 1.64 | A | A | A | 97.1 | A | — |
| 3 | −31 | 1.58 | A | A | A | 99.2 | 1.55 | A | A | A | 98.0 | A | — |
| 4 | −30 | 1.59 | B | B | B | 98.5 | 1.58 | B | B | B | 98.0 | A | — |
| 5 | −23.1 | 1.66 | B | A | B | 99.5 | 1.63 | B | A | B | 98.7 | A | — |
| 6 | −29.1 | 1.57 | A | B | B | 98.0 | 1.60 | A | B | B | 97.0 | A | — |
| 7 | −22 | 1.63 | B | B | B | 98.4 | 1.68 | B | B | B | 97.7 | A | — |
| 8 | −20.4 | 1.70 | B | A | B | 96.2 | 1.75 | B | B | C | 93.7 | B | — |

TABLE 2-continued

| Ex. or Comp. Ex. | T.C. (23° C./60% RH) (μC/g) | Image forming performances: Initial stage I.D. | Halftone | CA carrier attach | Fog | Transfer rate (%) | Images after continuous operation I.D. | Halftone | CA | Fog | Transfer rate (%) | Filming | $T_{FI}$ (°C.) |
|---|---|---|---|---|---|---|---|---|---|---|---|---|---|
| 9 | −27.7 | 1.56 | B | B | B | 97.0 | 1.52 | B | B | B | 93.4 | B | — |
| 10 | −30.2 | 1.66 | A | A | A | 99.2 | 1.65 | A | A | A | 98.8 | A | 140 |
| Comp. Ex. 1 | −22.9 | 1.63 | D | A | C | 93.5 | 1.73 | E | A | E | 83.1 | E | — |
| 2 | −28.1 | 1.56 | C | D | D | 95.1 | 1.60 | C | D | D | 92.4 | A | — |
| 3 | −25.7 | 1.59 | A | C | D | 95.7 | 1.75 | B | C | E | — | — | — |
| 4 | −27.3 | 1.63 | A | A | A | 98.9 | 1.77 | C | B | E | 76.0 | E | 150 |
| 5 | −32.6 | 1.55 | B | A | C | 92.0 | 1.65 | C | A | D | 85.3 | C | 155 |
| 6 | −20.9 | 1.03 | D | B | E | 63.3 | — | — | — | — | — | — | — |
| 7 | −29.9 | 1.58 | B | A | A | 99.3 | 1.07 | E | A | B | — | — | — |
| 8 | −29.9 | 0.82 | E | A | A | — | — | — | — | — | — | — | — |

Notes to this table appear on the next pages.

Notes to Table 2

1. Headings for the respective columns represent the following items.

T.C.: Triboelectric chargeability (μC/g) of the toner in the developer system in an environment of 23° C./60% RH.

ID: Image density

Halftone: Halftone image reproducibility

CA: Carrier attachment

Fog: Fog

Transfer rate: Percentage of toner amount transferred from a photosensitive drum to a transfer material/amount of tone forming toner image on the photosensitive drum Filming: Toner filming on the photosensitive drum after continuous image formation $T_{FI}$: Fixing initiation temperature (lowest fixable temperature)

2. Evaluation results denoted by symbols A–E generally represent the following states measured and evaluated according to the manner shown below:

A: excellent, B: good, C: fair, D: rather poor, E: poor

Evaluation Method and Standard (1) ID (image density)

The image density of a solid image portion of an image formed on plain paper was measured as a relative density by using a reflective densitometer equipped with an SPI filter. ("Macbeth Color Checker RD-1255", available from Macbeth Co.).

(2) Halftone (reproducibility)

The roughness of a halftone image portion on a reproduced image was evaluated by comparing it with an original halftone image and several levels of reference reproduced images by eye observation.

(3) Carrier attachment

A solid white image reproduction was interrupted, and a transparent adhesive tape was intimately applied onto a region on the photosensitive drum between the developing station and cleaning station to sample magnetic carrier particles attached to the region. Then, the number of magnetic carrier particles attached onto a size of 5 cm×5 cm were counted to determine the number of attached carrier particles per $cm^2$. The results were evaluated according to the following standard:

A: less than 10 particles/$cm^2$,

B: 10—less than 20 particles/$cm^2$,

C: 20—less than 50 particles/$cm^2$,

D: 50—less than 100 particles/$cm^2$,

E: 100 particles/$cm^2$ or more (4) Fog

An average reflectance Dr (%) of an plane paper before image formation was measured by a densitometer ("TC-6MC", available from Tokyo Denshoku K.K.). Then, a solid white image was formed on an identical plain paper, and an average reflectance Ds (%) of the solid while image was measured in the same manner. Then, Fog (%) was calculated by the following formula:

$$\text{Fog}\ (\%) = Dr\ (\%) - Ds\ (\%).$$

The results were evaluated according to the following standard:

A: below 1.0%,

B: 1.0—below 1.5%,

C: 1.5—below 2.0%,

D: 2.0—below 3.0%,

E: 3.0% or higher.

(5) Filming (on the photosensitive drum)

The surface of the photosensitive drum after a continuous image formation was observed with eyes, and the results were evaluated while taking the resultant images also into consideration at 5 levels from A (no filming at all) to E (conspicuous filming to such an extent as to provide defects in the resultant images).

What is claimed is:

1. A magnetic coated carrier, comprising: magnetic coated carrier particles comprising magnetic carrier core particles and a resinous surface coating layer coating the magnetic carrier core particles, wherein (a) the magnetic carrier core particles has a resistivity of at least $1\times10^{10}$ ohm.cm, and the magnetic coated carrier has a resistivity of at least $1\times10^{12}$ ohm.cm, (b) the magnetic coated carrier has a number-average particle size of 1–100 μm and has such a particle size distribution that particles having particle sizes of at most a half of the number-average particle size occupy an accumulative percentage of at most 20% by number, (c) the magnetic coated carrier has a shape factor SF-1 of 100–130, (d) the magnetic coated carrier has a magnetization at 1 kilo-oersted of 40–250 emu/$cm^3$, and (e) the resinous surface coating layer comprises a coating resin composition which in turn comprises a straight silicone resin and a coupling agent, said straight silicone resin comprising trifunctional silicon and difunctional silicon in an atomic ratio of 100:0–40:60.

2. The magnetic coated carrier according to claim 1, wherein said magnetic carrier core particles comprise a binder resin and metal oxide particles.

3. The magnetic coated carrier according to claim 2, wherein the metal oxide particles are dispersed and contained in the binder resin.

4. The magnetic coated carrier according to claim 3, wherein the metal oxide particles are contained in a proportion of 50–99 wt. % in the magnetic coated carrier particles.

5. The magnetic coated carrier according to claim 3, wherein the metal oxide particles are contained in a proportion of 55–99 wt. % in the magnetic coated carrier particles.

6. The magnetic coated carrier according to claim 3, wherein the binder resin of the magnetic carrier core particles comprises a thermosetting resin, and the metal oxide particles comprise magnetic metal oxide particles.

7. The magnetic coated carrier according to claim 6, wherein the metal oxide particles comprise at least two species of metal oxide particles including at least one species of ferromagnetic metal oxide particles, and another species of metal oxide particles having a higher resistivity than the ferromagnetic material; said another species of metal oxide particles have number-average particle size which is larger than and at most 5 times that of the ferromagnetic metal oxide particles; and the ferromagnetic metal oxide particles occupy 30–95 wt. % of the total metal oxide particles in the core particles.

8. The magnetic coated carrier according to claim 6, wherein the binder resin of the magnetic carrier core particles comprises a thermosetting resin and has been formed by direct polymerization in the presence of the metal oxide particles.

9. The magnetic coated carrier according to claim 8, wherein the metal oxide particles have been lipophilicity-imparted.

10. The magnetic coated carrier according to claim 1, wherein the straight silicone resin comprises trifunctional silicon and difunctional silicon in an atomic ratio of 90:10–45:55.

11. The magnetic coated carrier according to claim 1, wherein said coating resin composition contains 0.001–0.2 wt. part of the coupling agent per 1 wt. part of the straight silicone resin.

12. The magnetic coated carrier according to claim 1, wherein said coating resin composition contains 0.01–0.1 wt. part of the coupling agent per 1 wt. part of the straight silicone resin.

13. The magnetic coated carrier according to claim 11, wherein said coupling agent comprises a silane coupling agent.

14. The magnetic coated carrier according to claim 11, wherein said coupling agent comprises a mixture of a silane coupling agent having an amino group and a silane coupling agent having a hydrophobic group.

15. The magnetic coated carrier according to claim 14, wherein the coupling agent having an amino group and the coupling agent having a hydrophobic group are mixed in a weight ratio of 10:1 to 1:10.

16. The magnetic coated carrier according to claim 1, wherein the magnetic coated carrier particles are coated with 0.05–10 wt. parts of said coating resin composition per 100 wt. parts thereof.

17. The magnetic coated carrier according to claim 1, wherein said straight silicone resin comprises an organosiloxane unit having difunctional silicon and an organosiloxane unit having trifunctional silicon of Formulae 1 and 2, respectively, shown below in combination:

Formula 1 di-functional silicon-containing organosiloxane unit

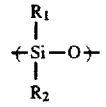

Formula 2 trifunctional silicon-containing organosiloxane unit

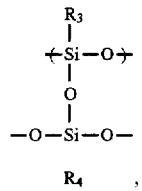

wherein $R_1$, $R_2$, $R_3$ and $R_4$ independently denote hydrogen atom, methyl group, phenyl group, or hydroxyl group.

18. The magnetic coated carrier according to claim 17, wherein $R_1$, $R_2$, $R_3$ and $R_4$ independently denote a methyl group or a phenyl group.

19. The magnetic coated carrier according to claim 1, wherein said coupling agent is a silane coupling agent having an amino group.

20. The magnetic coated carrier according to claim 19, wherein said silane coupling agent having an amino group is a compound selected from the group consisting of: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl-γ-aminopropyltrimethoxysilane.

21. The magnetic coated carrier according to claim 1, wherein said coupling agent is a silane coupling agent having a hydrophobic group.

22. The magnetic coated carrier according to claim 21, wherein said silane coupling agent having a hydrophobic group is a silane coupling agent having alkyl group, alkenyl group, halogenated alkyl group, halogenated alkenyl group, phenyl group, halogenated phenyl group, or alkyl phenyl group.

23. The magnetic coated carrier according to claim 22, wherein said silane coupling agent having a hydrophobic group comprises an alkoxysilane represented by the following formula: $R_mSiY_n$, wherein R denotes an alkoxy group, Y denotes an alkyl or vinyl group, and m and n are integers of 1–3.

24. The magnetic coated carrier according to claim 23, wherein said silane coupling agent having a hydrophobic group is a compound selected from the group consisting of vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy) silane.

25. The magnetic coated carrier according to claim 22, wherein said silane coupling agent having a hydrophobic group is a compound selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

26. The magnetic coated carrier according to claim 1, wherein said coupling agent is a silane coupling agent having an epoxy group.

27. The magnetic coated carrier according to claim 26, wherein said coupling agent is a compound selected from the group consisting of γ-glycidoxypropylmethyldiethoxysilane, γ-glycidoxypropyltriethoxysilane, and β-(3,4-epoxycyclohexyl)trimethoxysilane.

28. The magnetic coated carrier according to claim 3, wherein the metal oxide particles are exposed to the surface of the magnetic coated carrier particles at a rate of 0.1–10 particles/$\mu m^2$.

29. The magnetic coated carrier according to claim 9, wherein the metal oxide particles have been lipophilicity-imparted by treatment with a titanate coupling agent or a silane coupling agent having an amino group.

30. The magnetic coated carrier according to claim 7, wherein said ferromagnetic metal oxide particles comprise magnetite particles, and said another species of metal oxide particles comprise hematite particles.

31. A two-component type developer for developing an electrostatic image, comprising: a toner and a magnetic coated carrier; wherein the magnetic coated carrier comprises magnetic coated carrier particles comprising magnetic carrier core particles and a resinous surface coated layer coating the magnetic carrier core particles, wherein (a) the magnetic carrier core particles has a resistivity of at least $1\times10^{10}$ ohm.cm, and the magnetic coated carrier has a resistivity of at least $1\times10^{12}$ ohm.cm, (b) the magnetic coated carrier has a number-average particle size of 1–100 μm and has such a particle size distribution that particles having particle sizes of at most a half of the number-average particle size occupy an accumulative percentage of at most 20% by number, (c) the magnetic coated carrier has a shape factor SF-1 of 100–130, (d) the magnetic coated carrier has a magnetization at 1 kilo-oersted of 40–250 emu/$cm^3$, and (e) the resinous surface coating layer comprises a coating resin composition which in turn comprises a straight silicone resin and a coupling agent, said straight silicone resin comprising trifunctional silicon and difunctional silicon in an atomic ratio of 100:0–40:60.

32. The developer according to claim 31, wherein the toner has a weight-average particle size (D4) of 1–10 μm, contains at most 20% by number of particles having sizes of at most a half its number-average particle size (D1), contains at most 10% by volume of particles having sizes of at least two times D4, and has a shape factor SF-1 of 100–140.

33. The developer according to claim 31, wherein said toner comprises toner particles, and an external additive added thereto comprising inorganic fine particles having a number-average particle size of at most 0.2 μm or organic fine particles having a number-average particle size of at most 0.2 μm.

34. The developer according to claim 33, wherein said toner particles have a surface area of which 5–99% is covered with the inorganic fine particles, the organic fine particles or a mixture thereof.

35. The developer according to claim 33, wherein the toner particles have structure including a core and a shell coating the core.

36. The developer according to claim 35, wherein the core comprises a low-softening point substance having a melting point of 40°–90° C.

37. The developer according to claim 36, wherein the low-softening point substance is contained in a proportion of 5–30 wt. % in the toner particles.

38. The developer according to claim 31, wherein said magnetic carrier core particles comprise a binder resin and metal oxide particles.

39. The developer according to claim 38, wherein the metal oxide particles are dispersed and contained in the binder resin.

40. The developer according to claim 39, wherein the metal oxide particles are contained in a proportion of 50–99 wt. % in the magnetic coated carrier particles.

41. The developer according to claim 39, wherein the metal oxide particles are contained in a proportion of 55–99 wt. % in the magnetic coated carrier particles.

42. The developer according to claim 39, wherein the binder resin of the magnetic carrier core particles comprises a thermosetting resin, and the metal oxide particles comprise magnetic metal oxide particles.

43. The developer according to claim 42, wherein the metal oxide particles comprise at least two species of metal oxide particles including at least one species of ferromagnetic metal oxide particles, and another species of metal oxide particles having a higher resistivity than the ferromagnetic material; said another species of metal oxide particles have number-average particle size which is larger than and at most 5 times that of the ferromagnetic metal oxide particles; and the ferromagnetic metal oxide particles occupy 30–95 wt. % of the total metal oxide particles in the core particles.

44. The developer according to claim 42, wherein the binder resin of the magnetic carrier core particles comprises a thermosetting resin and has been formed by direct polymerization in the presence of the metal oxide particles.

45. The developer according to claim 44, wherein the metal oxide particles have been lipophicity-imparted.

46. The developer according to claim 31, wherein the straight silicone resin comprises trifunctional silicon and difunctional silicon in an atomic ratio of 90:10–45:55.

47. The developer according to claim 31, wherein said coating resin composition contains 0.001–0.2 wt. part of the coupling agent per 1 wt. part of the straight silicone resin.

48. The developer according to claim 31, wherein said coating resin composition contains 0.01–0.1 wt. part of the coupling agent per 1 wt. part of the straight silicone resin.

49. The developer according to claim 47, wherein said coupling agent comprises a silane coupling agent.

50. The developer according to claim 47, wherein said coupling agent comprises a mixture of a silane coupling agent having an amino group and a silane coupling agent having a hydrophobic group.

51. The developer according to claim 50, wherein the coupling agent having an amino group and the coupling agent having a hydrophobic group are mixed in a weight ratio of 10:1 to 1:10.

52. The developer according to claim 31, wherein the magnetic coated carrier particles are coated with 0.05–10 wt. parts of said coating resin composition per 100 wt. parts thereof.

53. The developer according to claim 31, wherein said straight silicone resin comprises an organosiloxane having difunctional silicone and an organosiloxane unit having trifunctional silicone of Formulae 1 and 2, respectively, shown below in combination:

Formula 1 di-functional silicon-containing organosiloxane unit

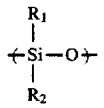

Formula 2 trifunctional silicon-containing organosiloxane unit

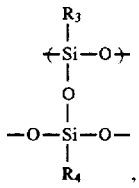

wherein $R_1$, $R_2$, $R_3$ and $R_4$ independently denote hydrogen atom, methyl group, phenyl group, or hydroxyl group.

54. The developer according to claim 53, wherein $R_1$, $R_2$, $R_3$ and $R_4$ independently denote a methyl group or a phenyl group.

55. The developer according to claim 31, wherein said coupling agent is a silane coupling agent having an amino group.

56. The developer according to claim 55, wherein said silane coupling agent having an amino group is a compound selected from the group consisting of: γ-aminopropyltrimethoxysilane, γ-aminopropylmethoxydiethoxysilane, N-β-aminoethyl-γ-aminopropyltrimethoxysilane, γ-aminopropylmethyldiethoxysilane, N-β-aminoethyl-γ-aminopropylmethyldimethoxysilane, γ-2-aminoethylaminopropyltrimethoxysilane, and N-phenyl-γ-aminopropyltrimethoxysilane.

57. The developer according to claim 31, wherein said coupling agent is a silane coupling agent having a hydrophobic group.

58. The developer according to claim 57, wherein said silane coupling agent having a hydrophobic group is a silane coupling agent having alkyl group, alkenyl group, halogenated alkyl group, halogenated alkenyl group, phenyl group, halogenated phenyl group, or alkyl phenyl group.

59. The developer according to claim 58, wherein said silane coupling agent having a hydrophobic group comprises an alkoxysilane represented by the following formula: $R_mSiY_n$, wherein R denotes an alkoxy group, Y denotes an alkyl or vinyl group, and m and n are integers of 1–3.

60. The developer according to claim 59, wherein said silane coupling agent having a hydrophobic group is a compound selected from the group consisting of vinyltrimethoxysilane, vinyltriethoxysilane, vinyltriacetoxysilane, methyltrimethoxysilane, methyltriethoxysilane, isobutyltriethoxysilane, dimethyldimethoxysilane, dimethyldiethoxysilane, trimethylmethoxysilane, n-propyltrimethoxysilane, phenyltrimethoxysilane, n-hexadecyltrimethoxysilane, n-octadecyltrimethoxysilane, and vinyltris(β-methoxy) silane.

61. The developer according to claim 58, wherein said silane coupling agent having a hydrophobic group is a compound selected from the group consisting of vinyltrichlorosilane, hexamethyldisilazane, trimethylsilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, and chloromethyldimethylchlorosilane.

62. The developer according to claim 31, wherein said coupling agent is a silane coupling agent having an epoxy group.

63. The developer according to claim 62, wherein said coupling agent is a compound selected from the group consisting of γ-glycidoxy-propylmethyldiethoxysilane, γ-glycidoxypropyl-triethoxysilane, and β-(3,4-epoxycyclohexyl)-trimethoxysilane.

64. The developer according to claim 39, wherein the metal oxide particles are exposed to the surface of the magnetic coated carrier particles at a rate of 0.1–10 particles/$\mu m^2$.

65. The developer according to claim 45, wherein the metal oxide particles have been lipophilicity-imparted by treatment with a titanate coupling agent or a silane coupling agent having an amino group.

66. The developer according to claim 43, wherein said ferromagnetic metal oxide particles comprise magnetite particles, and said another species of metal oxide particles comprises hematite particles.

67. A developing method, comprising: carrying a two-component type developer on a developer-carrying member enclosing therein a magnetic field generating means, forming a magnetic brush of the two-component type developer on the developer-carrying member, causing the magnetic brush to contact an image-bearing member, and developing an electrostatic image on the image-bearing member while applying an alternating electric field to the developer-carrying member;

wherein the two-component type developer comprises a toner and a magnetic coated carrier; wherein the magnetic coated carrier comprises magnetic coated carrier particles comprising magnetic carrier core particles and a resinous surface coated layer coating the magnetic carrier core particles, wherein (a) the magnetic carrier core particles has a resistivity of at least $1\times10^{10}$ ohm.cm, and the magnetic coated carrier has a resistivity of at least $1\times10^{12}$ ohm.cm, (b) the magnetic coated carrier has a number-average particle size of 1–100 μm and has such a particle size distribution that particles having particle sizes of at most a half of the number-average particle size occupy an accumulative percentage of at most 20% by number, (c) the magnetic coated carrier has a shape factor SF-1 of 100–130, (d) the magnetic coated carrier has a magnetization at 1 kilo-oersted of 40–250 emu/$cm^3$, and (e) the resinous surface coating layer comprises a coating resin composition which in turn comprises a straight silicone resin and a coupling agent, said straight silicone resin comprising trifunctional silicon and difunctional silicon in an atomic ratio of 100:0–40:60.

68. The method according to claim 67, wherein the alternating electric field has a peak-to-peak voltage of 500–5000 volts and a frequency of 500–10,000 Hz.

69. The method according to claim 68, wherein the alternating electric field has a frequency of 500–3000 Hz.

70. The method according to claim 67, wherein said developer-carrying member and said image-bearing member are disposed with a minimum spacing therebetween of 100–1000 μm.

71. The method according to claim 67, wherein said two-component type developer is a developer according to any one of claims 32–66.

72. The method according to claim 67, wherein the developer carrying member has a surface unevenness satisfying the following conditions: 0.2 μm≦center line-average roughness (Ra)≦5.0 μm, 10 μm≦average unevenness spacing (Sm)≦80 μm and 0.05≦Ra/Sm≦0.5.

* * * * *

UNITED STATES PATENT AND TRADEMARK OFFICE

CERTIFICATE OF CORRECTION

PATENT NO. : 5,766,814

DATED : June 16, 1998

INVENTOR(S): YOSHINOBU BABA, ET AL.

It is certified that error appears in the above-identified patent and that said Letters Patent is hereby corrected as shown below:

ON THE TITLE PAGE AT [57]
ABSTRACT, line 7, "has" should read --have--.

COLUMN 3
Line 12, delete "in case";
Line 55, "has" should read --have--.

COLUMN 4
Line 44, "magnetic" should read --magnet--.

COLUMN 5
Line 4, "voltage .." should read --voltage.--;
Line 30, "in case" should read --in the case--;
Line 34, "par t" should read --part--.

COLUMN 8
Line 13, "develop-" should read --a develop---;
Line 60, "however" should read --however,--.

COLUMN 11
Line 10, "p-nnonylstyrene," should read --p-n-nonylstyrene,--;
Line 26, "acrylate, antearyl" should read --acrylate, stearyl--.

UNITED STATES PATENT AND TRADEMARK OFFICE

CERTIFICATE OF CORRECTION

PATENT NO. : 5,766,814

DATED : June 16, 1998

INVENTOR(S): YOSHINOBU BABA, ET AL.

It is certified that error appears in the above-identified patent and that said Letters Patent is hereby corrected as shown below:

COLUMN 12
Line 41, "groups" should read --group,--;
Line 46, "is" should read --are--.

COLUMN 13
Line 59, "containing" should read --contains--.

COLUMN 14
Line 2, delete "through";
Line 12, "be heating" should read --by heating--.

COLUMN 15
Line 26, "preferably" should read --preferably have--;
Line 40, "particles," should read --particle,--.

COLUMN 16
Line 23, "measurement" should read --measurement of--.

COLUMN 17
Line 7, ""Luzex" should read --("Luzex--;
Line 58, "particles," should read --particles--.

COLUMN 19
Line 37, "an" should read --and--.

COLUMN 21
Line 27, "and odor" should read --all odor--.

UNITED STATES PATENT AND TRADEMARK OFFICE

CERTIFICATE OF CORRECTION

PATENT NO. : 5,766,814

DATED : June 16, 1998

INVENTOR(S): YOSHINOBU BABA, ET AL.

It is certified that error appears in the above-identified patent and that said Letters Patent is hereby corrected as shown below:

COLUMN 23
Line 4, "of" should read --of the--;
Line 27, "arbitrarily selected several" should read --several arbitrarily selected--;
Line 33, 33 "in" (2nd occurrence) should be deleted.

COLUMN 24
Line 10, "glipper" should read --gripper--;
Line 12, "alone" should read --along--;
Line 12, "upperstream" should read --upstream--;
Line 17, "about" should be deleted.

COLUMN 25
Line 4, "glipper" should read --gripper--;
Line 31, "glipper" should read --gripper--.

COLUMN 26
Line 19, "As a" should read --Since A--.

COLUMN 27
Line 1, "Particle" should read --Particles--;
Line 18, "mm" (both occurrences) should read --μm--;
Line 27, "are and" should read --are admixed and--.

COLUMN 28
Line 17, "a "particulation".)" should read --as "particulation".)--;
Line 53, insert: "Production Example C (polymerization toner).

UNITED STATES PATENT AND TRADEMARK OFFICE

CERTIFICATE OF CORRECTION

PATENT NO. : 5,766,814

DATED : June 16, 1998

INVENTOR(S): YOSHINOBU BABA, ET AL.

It is certified that error appears in the above-identified patent and that said Letters Patent is hereby corrected as shown below:

COLUMN 29
Line 5, "Example" should read --Example A--.

COLUMN 30
Line 7, "result" should read --resulting--;
Line 8, "coarsely" should read --was coarsely--;
Line 40, "magnetic" should read --magnetic metal oxide particles--.

COLUMN 31
Line 54, "in" should be deleted.

COLUMN 32
Line 26, "(1)]" should read --(1))]--.

COLUMN 33
Line 26 "2.5:75" should read --25:75--.

COLUMN 35
Line 35, delete "good".

COLUMN 36
Line 11, "97.0%" should read --was 97.0%.--.

COLUMN 37
Line 6, "exhibited," should read --exhibited--.
Line 38, "an" should read --and--.

UNITED STATES PATENT AND TRADEMARK OFFICE

CERTIFICATE OF CORRECTION

PATENT NO. : 5,766,814

DATED : June 16, 1998

INVENTOR(S) : YOSHINOBU BABA, ET AL.

It is certified that error appears in the above-identified patent and that said Letters Patent is hereby corrected as shown below:

COLUMN 39

(1st occurrence)

Line 52, "an" should read --and--.

COLUMN 40

Line 52, "slight" should read --slightly--.

COLUMN 43

Line 61, "of an" should read --of a--;

Line 65, "while" should read --white--.

COLUMN 44

Line 53, "has" should read "have"

COLUMN 47

Line 38, "has" should read --have--.

COLUMN 50

Line 45, "has" should read --have--.

Signed and Sealed this

Fourth Day of May, 1999

*Attest:*

Q. TODD DICKINSON

*Attesting Officer*

*Acting Commissioner of Patents and Trademarks*